US008820278B2

(12) United States Patent
Kobayashi et al.

(10) Patent No.: US 8,820,278 B2
(45) Date of Patent: Sep. 2, 2014

(54) VALVE TIMING CONTROL APPARATUS

(75) Inventors: Masaki Kobayashi, Okazaki (JP); Kazunari Adachi, Chiryu (JP); Mitsuru Uozaki, Obu (JP); Kenji Fujiwaki, Kariya (JP); Shohei Masuda, Kariya (JP)

(73) Assignee: Aisin Seiki Kabushiki Kaisha, Kariya-Shi, Aichi (JP)

( * ) Notice: Subject to any disclaimer, the term of this patent is extended or adjusted under 35 U.S.C. 154(b) by 95 days.

(21) Appl. No.: 13/392,563

(22) PCT Filed: Sep. 9, 2010

(86) PCT No.: PCT/JP2010/065501

§ 371 (c)(1),
(2), (4) Date: Feb. 27, 2012

(87) PCT Pub. No.: WO2011/055589

PCT Pub. Date: May 12, 2011

(65) Prior Publication Data

US 2012/0152190 A1 Jun. 21, 2012

(30) Foreign Application Priority Data

Nov. 4, 2009 (JP) ..... 2009-253278

(51) Int. Cl.
*F01L 1/34* (2006.01)
*F01L 1/344* (2006.01)

(52) U.S. Cl.
CPC ..... *F01L 1/3442* (2013.01); *F01L 2001/34466* (2013.01); *F01L 2001/34483* (2013.01); *F01L 2001/34476* (2013.01); *F01L 2001/34463* (2013.01); *F01L 2001/34473* (2013.01)
USPC ..... 123/90.15; 123/90.17; 464/160

(58) Field of Classification Search
CPC ..... F01L 1/3442; F01L 2001/34463; F01L 2001/34466; F01L 2001/34476
USPC ..... 123/90.15, 90.17; 464/160
See application file for complete search history.

(56) References Cited

U.S. PATENT DOCUMENTS 6,053,139 A 4/2000 Eguchi et al.
6,058,897 A 5/2000 Nakayoshi
(Continued)

FOREIGN PATENT DOCUMENTS

CN 101560893 10/2009
DE 199 14 767 A1 10/1999
(Continued)

OTHER PUBLICATIONS

Notification of Transmittal of Translation of the International Preliminary Report on Patentability(Chapter I or Chapter II)(PCT/IB/338), International Preliminary Report on Patentability (PCT/IB1373) and the Written Opinion of the International Searching Authority (Form PCT/ISA/237) issued on Jun. 21, 2012, in the corresponding International Application No. PCT/JP2010/065501. (7 pages).

(Continued)

*Primary Examiner* — Ching Chang
(74) *Attorney, Agent, or Firm* — Buchanan Ingersoll & Rooney PC

(57) ABSTRACT

A valve timing control apparatus includes a driving-side rotary body, a driven-side rotary body, a fluid pressure chamber partitioned into a retard angle chamber and an advance angle chamber by a partitioning portion provided in at least one of the driving-side rotary body and the driven-side rotary body, a fluid control mechanism for controlling feeding of working fluid from a working fluid pump for feeding the working fluid to the fluid pressure chamber and controlling also discharging of the working fluid from the fluid pressure chamber, a first lock mechanism capable of restraining a relative rotational phase to a first predetermined phase between a most retarded angle phase and a most advanced angle phase, and a second lock mechanism capable of restraining the relative rotational phase to a second predetermined phase different from the first predetermined phase.

17 Claims, 13 Drawing Sheets

(56) References Cited

U.S. PATENT DOCUMENTS

| | | | | |
|---|---|---|---|---|
| 6,439,181 | B1 * | 8/2002 | Fujiwaki et al. | 123/90.17 |
| 6,443,113 | B1 * | 9/2002 | Kanada et al. | 123/90.17 |
| 6,450,137 | B2 | 9/2002 | Ogawa | |
| 6,876,460 | B2 * | 4/2005 | Torigoe | 358/1.14 |
| 7,213,554 | B2 * | 5/2007 | Kanada et al. | 123/90.17 |
| 7,494,193 | B2 * | 2/2009 | Wedekind | 303/2 |
| 8,201,529 | B2 * | 6/2012 | Yamaguchi et al. | 123/90.17 |
| 2002/0038640 | A1 | 4/2002 | Fujiwaki et al. | |
| 2002/0043230 | A1 | 4/2002 | Kinugawa | |
| 2002/0139332 | A1 | 10/2002 | Takenaka | |
| 2005/0016481 | A1 | 1/2005 | Komazawa et al. | |
| 2006/0130790 | A1 | 6/2006 | Kanada et al. | |
| 2007/0144475 | A1 | 6/2007 | Suzuki et al. | |
| 2008/0223322 | A1 | 9/2008 | Stubbemann et al. | |
| 2009/0250028 | A1 | 10/2009 | Fujiyoshi et al. | |
| 2009/0260591 | A1 | 10/2009 | Yamaguchi et al. | |
| 2009/0266322 | A1 | 10/2009 | Fischer | |

FOREIGN PATENT DOCUMENTS

| | | | |
|---|---|---|---|
| DE | 199 18 910 | A1 | 11/1999 |
| DE | 10 2005 036 707 | A1 | 2/2007 |
| DE | 10 2009 002 405 | A1 | 10/2009 |
| EP | 1 672 188 | A1 | 6/2006 |
| JP | 2001-241307 | A | 9/2001 |
| JP | 2002-061504 | A | 2/2002 |
| JP | 2002-357105 | A | 12/2002 |
| JP | 2004-257313 | A | 9/2004 |
| JP | 2006-322409 | A | 11/2006 |
| JP | 2006-348926 | A | 12/2006 |
| JP | 2007-64127 | A | 3/2007 |
| JP | 2007-154748 | A | 6/2007 |
| JP | 2007-198365 | | 8/2007 |
| JP | 2009-250073 | A | 10/2009 |

OTHER PUBLICATIONS

Extended European Search Report dated Nov. 8, 2012, issued by the European Patent Office in the corresponding European Application No. 10828149.4. (5 pages).

International Search Report (PCT/ISA/210) issued on Nov. 22, 2010, by Japanese Patent Office as the International Searching Authority for International Application No. PCT/JP2010/065501.

Written Opinion (PCT/ISA/237) issued on Nov. 22, 2010, by Japanese Patent Office as the International Searching Authority for International Application No. PCT/JP2010/065501.

Chinese Office Action issued on Aug. 5, 2013 by the Chinese Patent Office in corresponding Chinese Patent Application No. 201080050133, and English translation thereof.

Japanese Office Action dated Feb. 13, 2014 issued in the corresponding Japanese Patent Application No. 2011-539311 and Partial English language translation.

* cited by examiner

VALVE TIMING CONTROL APPARATUS

TECHNICAL FIELD

The present invention relates to a valve timing control apparatus for controlling opening/closing timings of an intake valve and an exhaust valve of an internal combustion engine for use in an automobile,

BACKGROUND ART

Conventionally, as shown in PTL 1, there is known a valve timing control apparatus including a driving-side rotary body ("a rotation transmitting member" in the document), a driven-side rotary body ("a rotary member" in the document), a fluid pressure chamber formed by the driving-side rotary body and the driven-side rotary body and partitioned into a retard angle chamber and an advance angle chamber by a partitioning portion ("a vane" in the document) provided in the driven-side rotary body, and a fluid control mechanism ("a control valve" in the document) for controlling feeding of the working fluid from a working fluid pump ("an oil pump" in the document) for feeding working fluid and controlling also discharging of the working fluid from the fluid pressure chamber.

The invention described in PTL 1 further includes a first relative rotation restricting means for restricting relative rotational phase of the driven-side rotary body relative to the driving-side rotary body to a range from a most retarded angle phase to a predetermined phase between the most retarded angle phase and a most advanced angle phase and a second relative rotation restricting means for restricting the relative rotational phase from the most advanced angle phase to the predetermined phase. The first relative rotation restricting means includes a first lock pin provided on the side of the driving-side rotary body and a first restricting groove formed in the driven-side rotary body and having a predetermined width along the relative rotation direction. In operation, when the first lock pin protrudes into the first restricting groove, the relative rotational phase can be restricted within the range from the most retarded angle phase to the predetermined phase. Further, similarly to the above, the second relative rotation restricting means too includes a second lock pin and a second restricting groove. In operation, when the second lock pin protrudes into the second restricting groove, the relative rotational phase can be restricted within the range from the most advanced angle phase to the predetermined phase.

In association with feeding of working fluid into the fluid pressure chamber, the working fluid is fed also into the first restricting groove and the second restricting groove, whereby the first lock pin and the second lock pin are respectively retracted from the first restricting groove and the second restricting groove. On the other hand, when the engine is stopped and the working fluid is discharged from the first restricting groove and the second restricting groove, the first lock pin and the second lock pin both protrude into the first restricting groove and the second restricting groove. Namely, the relative rotational phase is restrained to the predetermined phase.

With this arrangement, the engine can be restarted with the relative rotational phase being restrained to the predetermined phase in a reliable manner. Therefore, with setting of the predetermined phase to a desired phase, the relationship between the air intake timing and the ignition timing can be optimized, thereby to improve the starting performance of the engine. For instance, it is possible to obtain an engine with low emission of harmful combustion exhaust product such as hydrocarbon (HC).

Incidentally, with hybrid vehicles which recently attract increasing attention, in order to alleviate the shock (transfer shock) at the time of switchover from a traveling operation using a motor to a traveling operation using an internal combustion engine, an arrangement is sometimes made such that at the time of startup from the stopped condition of the internal combustion engine, the relative rotational phase is set to a phase capable of delayed closing of the intake valve (this phase will be referred to as "a decompression phase" hereinafter), thereby to decompress the inside of the combustion chamber (decompression). However, even when the internal combustion engine is stopped at this decompression phase, it is sometimes difficult to maintain the relative rotational phase to the decompression phase due to torque variation at the time of startup of the internal combustion engine. Then, if a predetermined phase is set to the decompression phase, it is possible to maintain the relative rotational phase to the decompression phase reliably, thereby to improve the reliability in alleviation of the transfer shock.

Meanwhile, normally, during an engine operation, displacement forces in the retard angle direction and the advance angle direction due to torque variations of the camshaft are applied to the drive-side rotary body. When averaged, the resultant displacement force is effective in the retard angle direction, so that the driven-side rotary body tends to be displaced in the retard angle direction. In the following discussion, the averaged displacement force of the displacement forces in the retard angle direction and the advance angle direction due to torque variations of the camshaft will be referred to as "the averaged displacement force in the retard angle direction based on torque variations of the camshaft". In the case of the valve timing control apparatus described in PTL 1, by provision of a torsion spring for applying torque in the advance angle direction to the driven-side rotary body, it is made possible to displace the relative rotational phase in the advance angle direction in a smooth and speedy manner, in spite of the averaged displacement force in the retard angle direction based on torque variations of the camshaft.

CITATION LIST

Patent Literature

PTL 1: Japanese Unexamined Patent Application Publication No. 2001-241307 gazette

SUMMARY OF INVENTION

Technical Problem

In recent years, there is a need for improvement of fuel consumption performance of internal combustion engines in order to cope with e.g. environmental problems or the like, so that size reduction and capacity reduction of a working fluid feeding pump are being contemplated, whereby the feeding pressure of working fluid to the fluid pressure chamber is becoming lower. Further, research and development are being made also for reduction in the rotational speed of the internal combustion engine at the time of idling operation. With these, there is a need for development of a valve timing control apparatus that allows an appropriate operation condition to be obtained even when the feeding pressure is low.

Further, in the case of a valve timing control apparatus wherein the most retarded angle phase is set to a valve timing suitable for idling stability, at the time of low speed rotation such as an idling operation, the relative rotational phase is often set to the most retarded angle phase or to a phase adjacent the most retarded angle phase. Further, at the time of high oil temperature, low speed rotation, the feeding pressure of the working fluid is considerably low. Therefore, if size reduction/capacity reduction of the pump is done, this will lead to further reduction in the feeding pressure of the working fluid at the time of low speed rotation such as an idling operation, so that it becomes difficult to maintain the relative rotational phase to a desired phase. As a result, with the displacement forces in the retard angle direction and the advance angle direction based on torque variations, there occurs fluttering of the driven-side rotary body in the retard angle direction and the advance angle direction, whereby stable operation condition cannot be obtained.

In the valve timing control apparatus described in PTL 1, if size reduction/capacity reduction of the pump is made, this will result not only in reduction in the feeding pressure of the working fluid at the time of idling operation, but also because of the provision of the torsion spring described above, the displacement force in the retard angle direction based on the feeding pressure of the working fluid acting on the driven-side rotary body will be alleviated by the urging force of the torsion spring in the advance angle direction. As a result, it becomes even more difficult to stably maintain the relative rotational phase to the phase adjacent the most retarded angle phase. Therefore, the driven-side rotary body will flutter, whereby stable idling operation cannot be obtained, or noise (hitting noise) due to the fluttering of the partitioning portion can occur.

In order to solve such problems as above, it is conceivable to increase the pressure-receiving area of the partitioning portion subject to the fluid pressure through e.g. enlargement of the fluid pressure chamber and the partitioning portion or increase the number of the fluid pressure chambers. However, these will lead to enlargement of the valve timing control apparatus, thus being contradictory to the above-described technical object.

The object of the present invention is to provide a valve timing control apparatus capable of restraining the relative rotational phase to a predetermined phase between a retard angle chamber and an advance angle chamber, and capable also of stably maintaining the relative rotational phase to a phase different from the predetermined phase even when the feeding pressure of the working fluid is low. Further, in the case of a hybrid vehicle, the object of the invention is to provide a valve timing control apparatus capable of reliably allowing startup of the internal combustion engine at the decompression phase by restraining the relative rotational phase to the decompression phase and capable also of preventing generation of hitting noise at the time of startup of the internal combustion engine.

Solution to Problem

According to the first characterizing feature of a valve timing control apparatus according to the present invention, the valve timing control apparatus comprises:

a driving-side rotary body rotatable in synchronism with a crankshaft of an internal combustion engine;

a driven-side rotary body mounted coaxial relative to the driving-side rotary body and rotatable in synchronism with a valve opening/closing camshaft of the internal combustion engine;

a fluid pressure chamber formed by the driving-side rotary body and the driven-side rotary body and partitioned into a retard angle chamber and an advance angle chamber by a partitioning portion provided in at least one of the driving-side rotary body and the driven-side rotary body;

a fluid control mechanism for controlling feeding of a working fluid from a working fluid pump for feeding the working fluid to the fluid pressure chamber and controlling also discharging of the working fluid from the fluid pressure chamber;

a first lock mechanism capable of restraining a relative rotational phase of the driven-side rotary body relative to the driving-side rotary body to a first predetermined phase between a most retarded angle phase and a most advanced angle phase; and a second lock mechanism capable of restraining the relative rotational phase to a second predetermined phase different from the first predetermined phase.

With the above-described arrangement, by means of the first lock mechanism and the second lock mechanism, the relative rotational phase can be restrained to two phases of different valve timings such as the first predetermined phase and the second predetermined phase. Therefore, for example, a control arrangement is made possible such that the internal combustion engine can be started in a favorable manner at the first predetermined phase and at the time of the idling operation subsequent thereto, the rotational phase can be retrained to the second predetermined phase. That is, even if there are exerted displacement forces in the retard angle direction and the advance angle direction based on torque variations of the camshaft, there occurs no fluttering of the driven-side rotary body relative to the driving-side rotary body, whether the feeding pressure of the working fluid is high or low. In this way, a favorable startup condition for the internal combustion engine can be obtained and also at the time of a desired operation different from the startup, a stable operation condition can be realized.

According to the second characterizing feature of the valve timing control apparatus relating to the present invention, at the time of restraint by the first lock mechanism, the second lock mechanism releases its restraint of the relative rotational phase.

With the above-described arrangement, at the time of restraint by the first lock mechanism, the restraint of the relative rotational phase by the second lock mechanism is released. Hence, condition of one lock mechanism does not affect the condition of the other lock mechanism, so that valve timing can be controlled with high accuracy.

According to the third characterizing feature of the valve timing control apparatus relating to the present invention, the first lock mechanism and the second lock mechanism respectively include a lock groove formed in either one of the driving-side rotary body and the driven-side rotary body and a lock member provided in the other one of the driving-side rotary body and the driven-side rotary body having the lock groove to be projectable/retractable into/from the lock groove, the lock member being projectable into the lock groove to be retained in this lock groove, thereby to restrain relative rotational movement of the driven-side rotary body relative to the driving-side rotary body.

With the above-described arrangement, as the first lock mechanism and the second lock mechanism respectively have such simple arrangement as a lock member and a lock groove, there occurs no complexity of flow passages, or the like. And, it is easy to arrange such that an operation of one lock mechanism does not affect an operation of the other lock mechanism. As a result, individual control of each lock mechanism is made easy and relative rotational phase of the driven-side rotary body can be restrained to phases at desired two positions in a reliable manner. Further, since the restraint of the relative rotational movement of the driven-side rotary body is provided by physical restraint between the lock member and the lock groove, a large restraining force is provided so that the reliability thereof is high also.

It should be noted, however, that the lock member may be provided in the driving-side rotary body and the lock groove may be provided in the driven-side rotary body. Alternatively, the lock member can be provided in the driven-side rotary body and the lock groove can be provided in the driving-side rotary body. Further, in the first lock mechanism and the second mechanism, the lock member or the lock groove respectively thereof need not be provided in the same side of rotary body and the rotary body including the lock member or the lock groove may be in reverse from each other.

According to the fourth characterizing feature of the valve timing control apparatus relating to the present invention, the first lock mechanism and the second lock mechanism respectively include a lock groove formed in either one of the driving-side rotary body and the driven-side rotary body, and the first lock mechanism and the second lock mechanism share a common lock member provided in the other one of the driving-side rotary body and the driven-side rotary body having the respective lock groove to be projectable/retractable into/from the lock groove, the lock member being projectable into the respective lock groove to be retained in this lock groove, thereby to restrain relative rotational movement of the driven-side rotary body relative to the driving-side rotary body to either the first predetermined phase or the second predetermined phase.

With the above-described arrangement, the first lock mechanism and the second lock mechanism respectively have a lock groove and share one same lock member at the same time. Therefore, the arrangement can be made simple and the number of parts can be reduced, thus making manufacturing cost reduction possible. Further, with the sharing of the lock member, sufficient margin of space can be provided in one of the driving-side rotary body and the driven-side rotary body which one rotary body includes the lock member.

For instance, in the case of exemplary arrangement wherein the lock member is provided in the driving-side rotary body and the lock groove is provided in the driven-side rotary body and the two lock mechanisms are disposed along the peripheral direction, spare space is created along the peripheral direction. Hence, it becomes possible to increase the number of fluid pressure chambers thereby to increase the force for displacing the relative rotational phase. Further, it becomes also possible to increase the width of the fluid pressure chamber in the peripheral direction, thereby to extend the displaceable range of the relative rotational phase.

According to the fifth characterizing feature of the valve timing control apparatus relating to the present invention, an advance angle passage connecting the fluid control mechanism to the advance angle chamber is connected to the lock groove in the second lock mechanism.

With the above-described arrangement, when the working fluid is fed to the advance angle passage, the working fluid is fed also to the lock groove of the second lock mechanism. Further, when the working fluid is discharged from the advance angle chamber through the advance angle passage, the working fluid is discharged also from the lock groove of the second lock mechanism. That is, only with execution of control for displacing the relative rotational phase to the most retarded angle phase, the lock member can be caused to protrude into the lock groove in the second lock mechanism. Also, only with execution of control for displacing the relative rotational phase to the advance angle side from the most retarded angle phase, the lock member can be caused to retract from the lock groove in the second lock mechanism. In this way, the control for displacing the relative rotational phase can be operatively linked with the restraint/restraint release of the relative rotational phase by the second lock mechanism required therefor. Hence, operations of the second lock mechanism according to the control situation of the relative rotational phase can be realized easily.

According to the sixth characterizing feature of the valve timing control apparatus relating to the present invention, the apparatus further comprises one fluid switchover mechanism for switching over the feeding/discharging of the working fluid to/from the first lock mechanism from/to the second lock mechanism.

With the above-described arrangement, the control of the second lock mechanism can be effected, without any dependence on the fluid control mechanism for controlling the relative rotational phase. As a result, it becomes possible to set the second predetermined phase to any other phase than the most retarded angle phase. Further, as both the first lock mechanism and the second lock mechanism are controlled by one fluid switchover mechanism, there is no increase in the number of components.

According to the seventh characterizing feature of the valve timing control apparatus relating to the present invention, the second predetermined phase is set to a phase on more retarded side than the first predetermined phase.

With the above-described arrangement, e.g. in the case of setting the relative rotational phase suitable for idling operation to a phase on more retarded side than the relative rotational phase suitable for timing immediate after startup of the internal combustion engine, a favorable valve opening/closing timing can be realized.

According to the eighth characterizing feature of the valve timing control apparatus relating to the present invention, the second predetermined phase is set to a phase which is more retard angle side than the first predetermined phase and which is at the most retarded angle phase or adjacent the most retarded angle phase.

With the above-described arrangement, in an intake-side valve timing control apparatus with its most retarded angle phase being set to a valve timing suitable for idling stability, even during an idling operation with the feeding pressure of the working fluid being low, the relative rotational phase can be set to the most retarded angle phase. Hence, stable idling operation can be realized.

DESCRIPTION OF EMBODIMENTS

Embodiments wherein the present invention is applied to a valve timing control apparatus for the intake valve side of an automobile engine will be described with reference to FIGS. 1 through 7. Namely, the automobile engine corresponds to "an internal combustion engine" in the present invention.

[General Construction]

Figure 1:
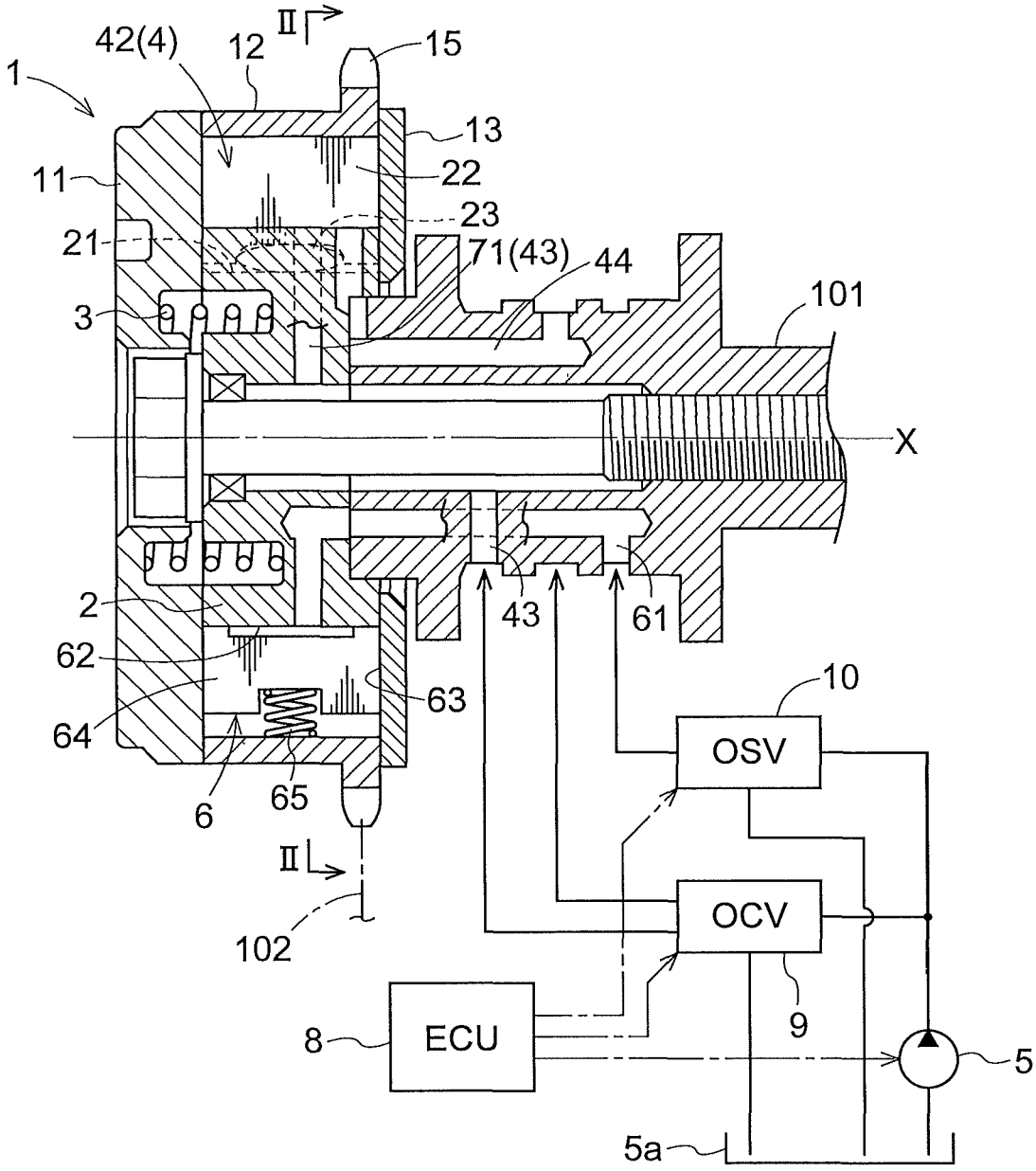
FIG. 1 is a view showing the general construction of a valve timing control apparatus relating to the present invention.

This valve timing control apparatus, as shown in FIG. 1, includes a housing 1 as a "driving-side rotary body" which is rotated in synchronism with a crankshaft of an unillustrated engine, and an inner rotor 2 which is mounted coaxial relative to the housing 1 and acting as a "driven-side rotary body" which is rotated in synchronism with a camshaft 101. The camshaft 101 is a rotary shaft for an unillustrated cam which controls opening/closing of the intake valve of the engine. Incidentally, the camshaft 101 is rotatably assembled to the cylinder head of the unillustrated engine.

Further, the valve timing control apparatus includes an intermediate lock mechanism 6 as a "first lock mechanism" configured to restrain the relative rotational phase of the inner rotor 2 relative to the housing 1 to a first predetermined phase between a most retarded angle phase and a most advanced angle phase, by restraining the relative rotational movement of the inner rotor 2 relative to the housing 1. The valve timing control apparatus still further includes a most retarded angle lock mechanism 7 as a "second lock mechanism" capable of restraining the relative rotational phase to a second predetermined phase different from he first predetermined phase.

[Inner Rotor and Housing]

The inner rotor 2, as shown in FIG. 1, is integrally assembled with the leading end of the camshaft 101. The inner rotor 2 is fastened and fixed to the leading end of the camshaft 101 by means of a bolt.

The housing 1 includes a front plate 11 on the opposite side to the side to which the camshaft 101 is connected, an outer rotor 12 integrally including a timing sprocket 15 and a rear plate 13 to the side the camshaft 101 is connected. The outer rotor 12 is mounted externally to the inner rotor 2 and clamped by the front plate 11 and the rear plate 13, with the front plate 11, the outer rotor 12 and the rear plate 13 being fastened together with bolts.

Figure 2:
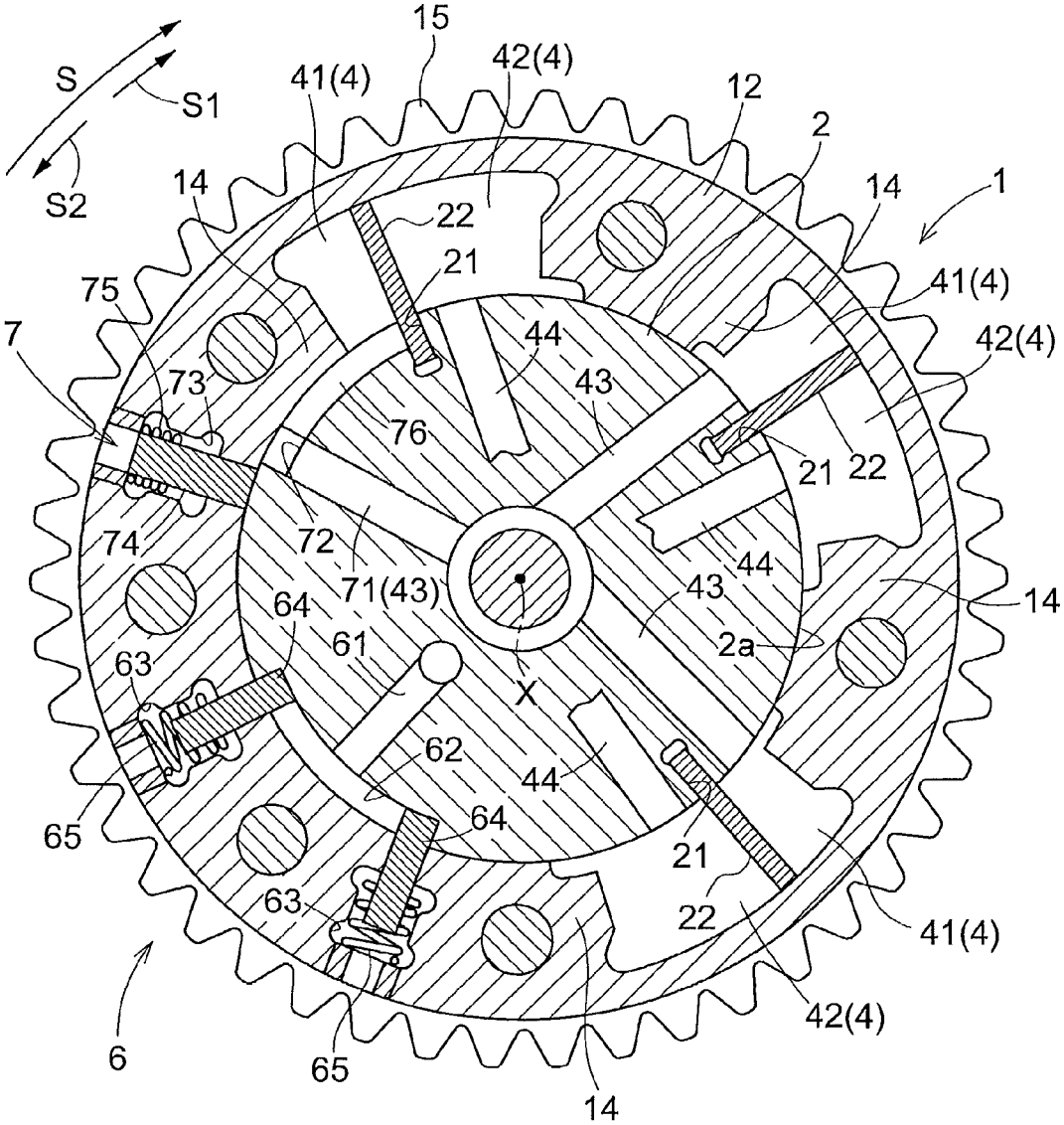
FIG. 2 is a section view taken along II-II in FIG. 1 showing the valve timing control apparatus under an intermediate locked state.

When the crankshaft is driven to rotate, this rotational force is transmitted to the timing sprocket 15 via a force transmission member 102, whereby the housing 1 is rotatably driven along a rotation direction S shown in FIG. 2. In association with this rotational drive of the housing 1, the inner rotor 2 is driven to rotate in the rotational direction S thereby to rotate the camshaft 101, whereby a cam mounted to the camshaft 101 pushes down and opens the intake valve of the engine.

As shown in FIG. 2, the outer rotor 12 forms a plurality of projecting portions 14 projecting in the radially inward direction and spaced apart from each other along the rotation direction S. The outer rotor 12 and the inner rotor 2 together form fluid pressure chambers 4. The projecting portion 14 functions as a "shoe" relative to an outer peripheral face 2*a* of the inner rotor 2. In the instant embodiment, the fluid pressure chambers 4 are provided at three positions. But, the invention is not limited thereto.

In the outer peripheral face 2*a* at a position thereof facing the fluid pressure chamber 4, a vane groove 21 is formed. And, in this vane groove 21, a vane 22 as a "partitioning portion" is disposed to extend to the radially outer side. The fluid pressure chamber 4 is partitioned by the vane 22 into an advance angle chamber 41 and a retard angle chamber 42 along the rotational direction S. A spring 23 is disposed between the vane groove 21 and the vane 22 to urge the vane 22 radially outward, thereby to prevent leak of a working fluid between the advance angle chamber 41 and the retard angle chamber 42.

As shown in FIG. 1 and FIG. 2, in communication with each advance angle chamber 41, an advance angle passage 43 is formed in the inner rotor 2 and the camshaft 101. Also, in communication with each retard angle chamber 42, a retard angle passage 44 is formed in the inner rotor 2 and the camshaft 101. As shown in FIG. 1, the advance angle passage 43 and the retard angle passage 44 are connected to unillustrated predetermined ports of an OCV 9 as a fluid control mechanism.

By controlling the OCV 9, the working fluid is fed/discharged to/from the advance angle chamber 41 and the retard angle chamber 42 or the feeding/discharging amount thereof is maintained, thereby to apply a fluid pressure to the vane 22. In this way, the relative rotational phase is displaced to the advance angle side or the retard angle side or the phase is maintained to a desired phase. Meanwhile, the advance angle direction is the direction in which the vane 22 effects relative rotational movement relative to the housing 1 to increase the capacity of the advance angle chamber 41 and this direction is indicated by an arrow S1 in FIG. 2. The retard angle direction is the direction in which the capacity of the retard angle chamber 42 is increased and this direction is indicated by an arrow S2 in FIG. 2.

With the above-described construction, the inner rotor 2 can effect smooth relative rotational movement relative to the housing 1 within a predetermined range about the rotational axis X. The predetermined range where the housing 1 and the inner rotor 2 can effect relative rotational movement, that is, the phase difference between the most advanced angle phase and the most retarded angle phase, corresponds to the range wherein the vane 22 is displaceable inside the fluid pressure chamber 4. Incidentally, the most retarded angle phase is the phase where the capacity of the retard angle chamber 42 is at its maximum. The most advanced angle phase is the phase where the capacity of the advance angle chamber 41 is at its maximum.

[Intermediate Lock Mechanism]

The intermediate lock mechanism 6 retains the housing 1 and the inner rotor 2 at predetermined phase positions in a situation when the fluid pressure of the working fluid is unstable immediately after startup of the engine, thereby to restrain the relative rotational phase to an intermediate lock phase as a "first predetermined phase" between the most retarded angle phase and the most advanced angle phase.

With this, the rotational phase of the camshaft 101 is maintained appropriate relative to the rotational phase of the crankshaft, thus realizing stable rotation of the engine. Incidentally, in the instant embodiment, the intermediate lock phase is set as a phase where the valve opening timing of the unillustrated intake valve is partially overlapped with the valve opening timing of the unillustrated exhaust valve. As a result, reduction in the amount of hydrocarbon (HC) at the time of startup of the engine is made possible, so that the engine can be rendered a low-emission engine.

The intermediate lock mechanism 6, as shown in FIG. 1 and FIG. 2, includes an intermediate lock passage 61, an intermediate lock groove 62, an accommodating portion 63, a plate-like intermediate lock member 64 and a spring 65.

The intermediate lock passage 61 is formed in the inner rotor 2 and the camshaft 101 and connects the intermediate lock groove 62 with an OSV 10 as "a fluid switchover mechanism" which will be described later. By controlling the OSV 10, the feeding/discharging of the working fluid to/from the intermediate lock groove 62 can be switched over independently. The intermediate lock groove 62 is formed in the outer peripheral face 2*a* of the inner rotor 2 and has a fixed width along the relative rotational direction. The accommodating portion 63 is formed at two positions in the outer rotor 12. Two intermediate lock members 64 are disposed within the respective accommodating portions 63 and can radially project/retract into/from the respective accommodating portions 63. The spring 65 is mounted within the accommodating portion 63 and urges each intermediate lock member 64 toward the radially inward direction, that is, toward the intermediate lock groove 62.

Figure 3:
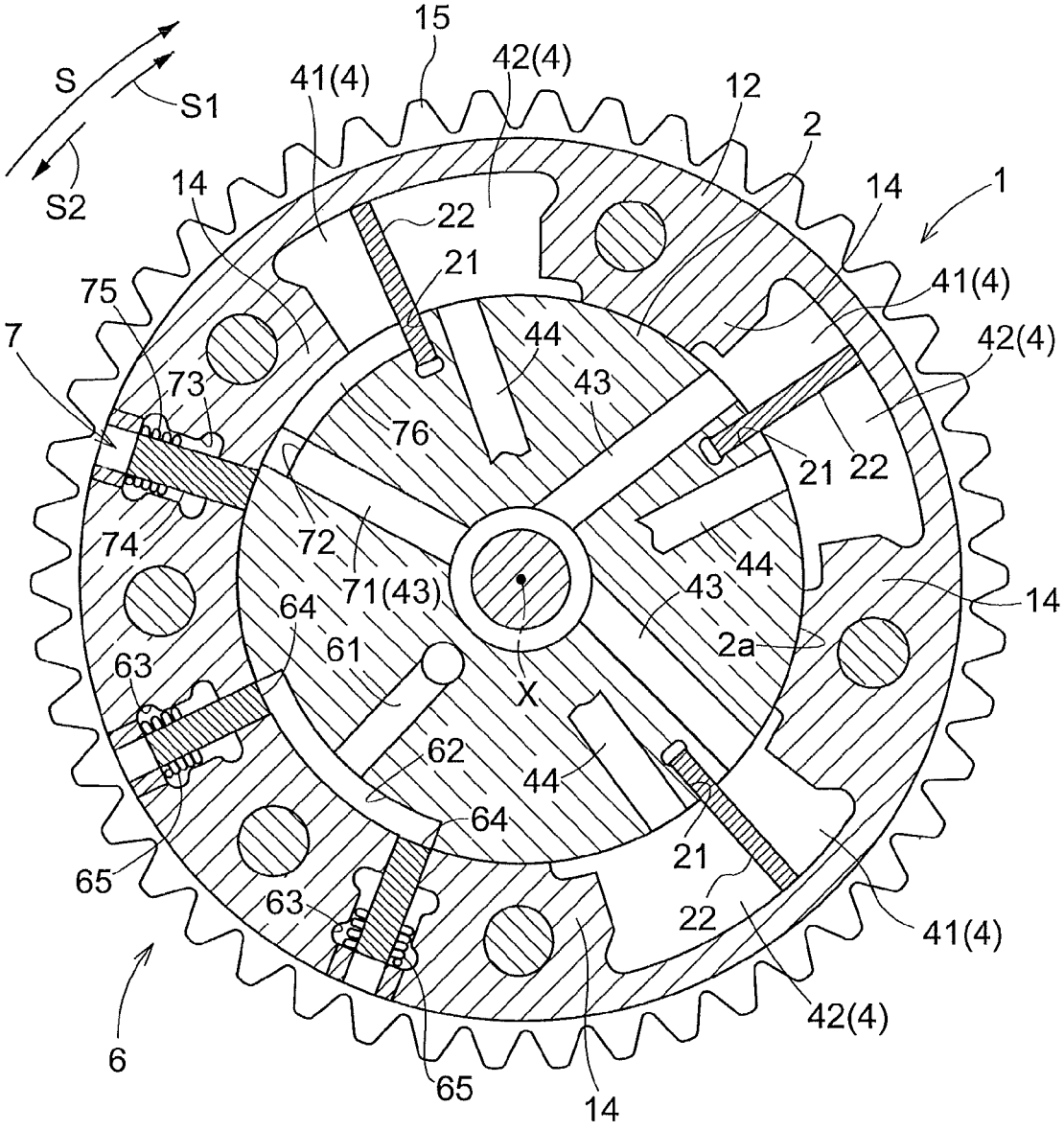
FIG. 3 is a section view showing the valve timing control apparatus when the intermediate locked state shown in FIG. 2 is released.

When the working fluid is discharged from the intermediate lock groove 62, each intermediate lock member 64 is caused to protrude into the intermediate lock groove 62. As shown in FIG. 2, when the both intermediate lock members 64 protrude into the intermediate lock groove 62, these respective intermediate lock members 64 will be retained simultaneously at the peripheral opposed ends of the intermediate lock groove 62. As a result, the relative rotational movement of the inner rotor 2 relative to the housing 1 is restrained and the relative rotational phase is restrained to the intermediate lock phase. When the working fluid is fed to the intermediate lock groove 62 by controlling the OCV 10, as shown in FIG. 3, the both intermediate lock member 64 will be retracted from the intermediate lock groove 62 into the respective accommodating portions 63, thus releasing the restrain of the relative rotational phase, whereby the relative rotational movement of the inner rotor 2 is made possible. In the following discussion, the condition in which the intermediate lock mechanism 6 restrains the relative rotational phase to the intermediate lock phase will be referred to as "the intermediate lock phase". Also, the condition where the intermediate lock phase is released will be referred to as "an intermediate lock released state".

Incidentally, as the shape of the intermediate lock member 64, any other shape such as a pin-like shape can be employed, instead of the plate-like shape shown in the instant embodiment.

[Most Retarded Angle Lock Mechanism]

The most retarded angle lock mechanism 7 maintains the housing 1 and the inner rotor 2 at predetermined relative positions at the time of a low speed rotation such as an idling operation, thereby to restrain the relative rotational phase to the most retarded angle phase as "a second predetermined phase". More particularly, as the inner rotor 2 will not effect relative rotational movement regardless of the displacement force in the retard angle direction or the advance angle direction based on torque variations of the camshaft, so that stable idling operation condition can be realized. Incidentally, in the instant embodiment, the most retarded angle phase is the phase where the valve closing timing of the exhaust valve is almost same as the valve opening timing of the intake valve and this is the phase where the idling operation condition is stable. Even when the relative rotational phase is at the most retarded angle phased, the engine can be started.

Figure 6:
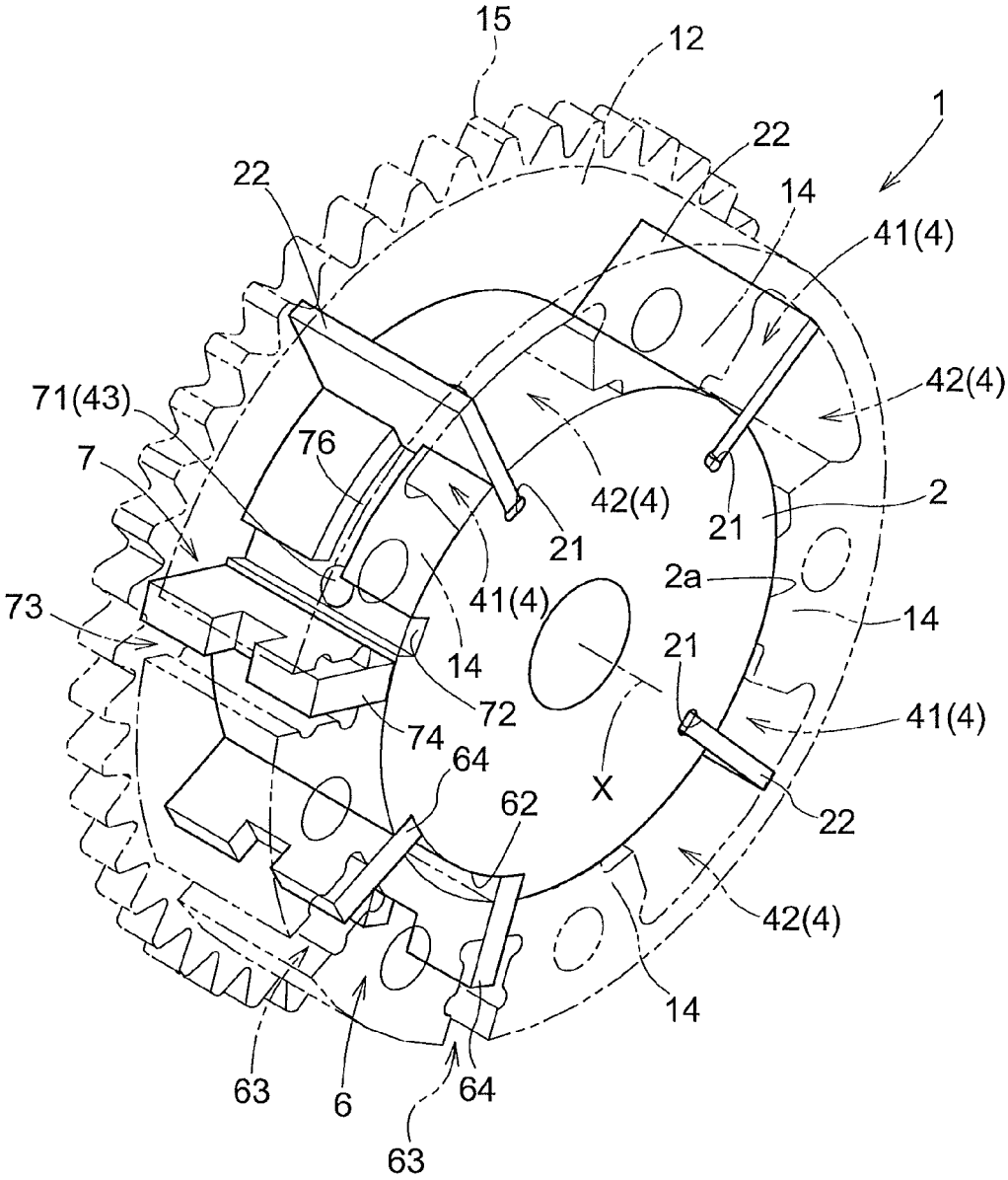
FIG. 6 is an exploded perspective view of the valve timing control apparatus.

The most retarded angle lock mechanism 7, as shown in FIG. 1, FIG. 2 and FIG. 6, includes a most retarded angle lock passage 71, a most retarded angle lock groove 72, an accommodating portion 73, a plate-like most retarded angle lock member 74 and a spring 75.

The most retarded angle lock passage 71 acts also as one of the advance angle passages 43 described above and connects the most retarded angle lock groove 72 with the OCV 9. Further, in the outer peripheral face 2*a* of the inner rotor 2, there is formed an advance angle communication passage 76 as a groove extending along the peripheral direction to the most retarded angle lock groove 72 and one of the vane grooves 21. In response to feeding/discharging of the working fluid to/from the advance angle chamber by the OSV 10, the working fluid is fed/discharged to/from the most retarded angle lock groove 72 as well. The accommodating portion 73 is formed in the outer rotor 12. The most retarded angle lock member 74 is accommodated in the accommodating portion 73 and can radially protrude/retract into/from the accommodating portion 73. The spring 75 is mounted within the accommodating portion 73 and urges the most retarded angle lock member 74 to the radially inward, that is, toward the most retarded angle lock groove 72.

Figure 4:
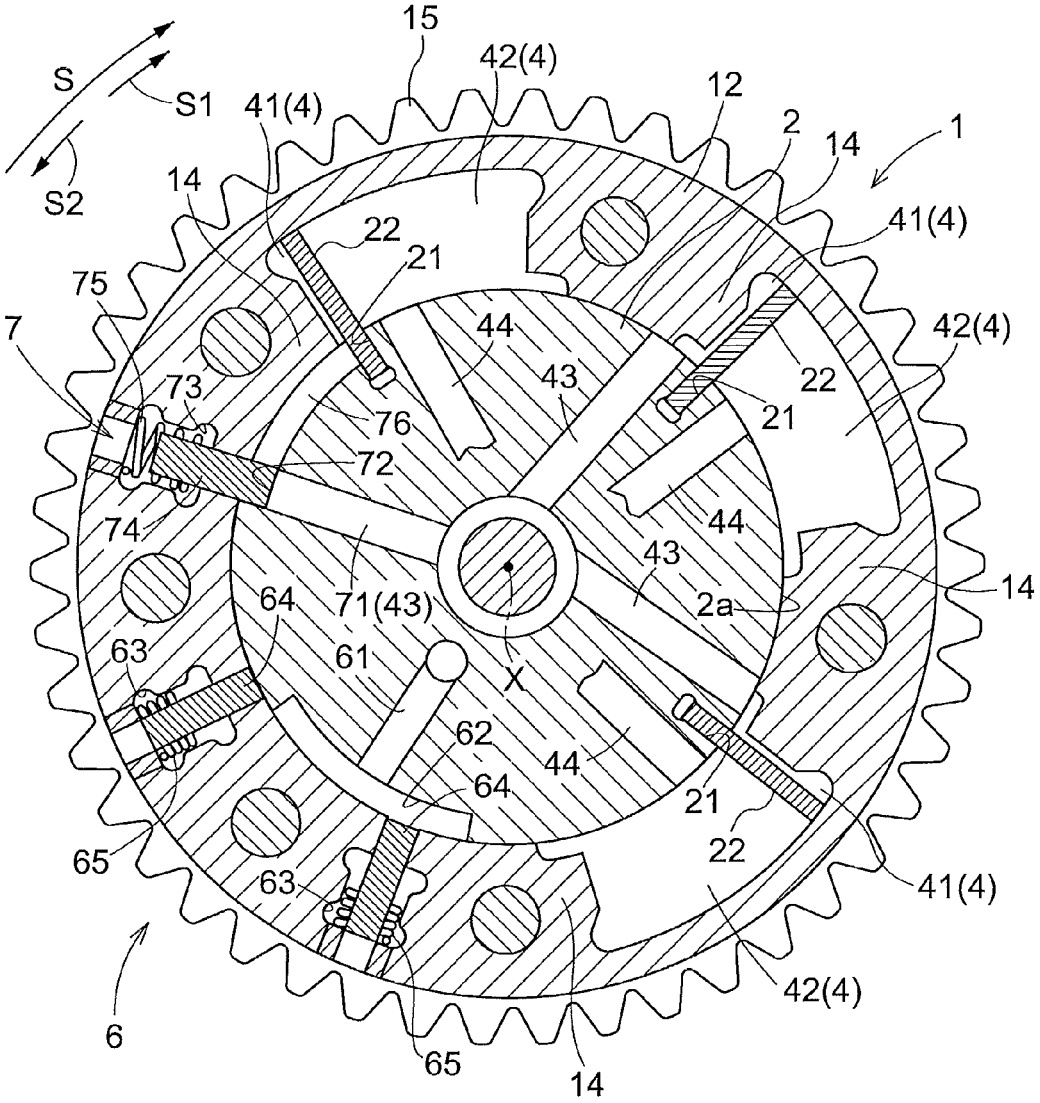
FIG. 4 is a section view showing the valve timing control apparatus when the relative rotational phase is at the most retarded angle phase.

When the working fluid is discharged from the most retarded angle groove 72, the most retarded angle lock member 74 is caused to protrude into the most retarded angle lock groove 72. As shown in FIG. 4, when the most retarded angle lock member 74 protrudes into the most retarded angle lock groove 72, the most retarded angle lock member 74 will be retained in the most retarded angle lock groove 72, whereby relative rotational movement of the inner rotor 2 relative to the housing 1 is restrained and the relative rotational phase is restrained to the most retarded angle phase. When the relative rotational phase is made to be displaced toward the advance angle side through control of the OCV 9, the working fluid will be fed into the most retarded angle lock groove 72, whereby the most retarded angle lock member 74 will be retracted from the most retarded angle groove 72 into the accommodating portion 73. That is, the restrain of the relative rotational phase is released. In the following discussion, the condition where the most retarded angle lock mechanism 7 restrains the relative rotational phase to the most retarded angle phase will be referred to as "most retarded angle lock state". And, the condition where the most retarded angle lock state is released will be referred to as "most retarded angle lock released state".

When the relative rotational phase is at a phase other than the most retarded angle phase, the most retarded angle lock member 74 is out of positional alignment with the most retarded angle lock groove 72, so the former only comes into slidable contact with the outer peripheral face 2*a* of the inner rotor 2. At these phases, that is, when the most retarded angle lock member 74 is retracted from the most retarded angle lock groove 72, the most retarded angle lock passage 71 and the advance angle chamber 41 are in constant communication with each other via the advance angle chamber communication passage 76.

Incidentally, as the shape of the most retarded angle lock member 74, any other shape than the plate-like shape shown in the instant embodiment can be employed. Further, the advance angle chamber communication passage 76 need not be the groove-like, but, though not shown, can be a shape formed by chamfering the outer peripheral corner portion of the inner rotor 2.

[Oil Pump]

The oil pump 5 as "a working fluid pump", when driven by the engine, effects feeding of the working oil, an example of the "working fluid". The oil pump 5 is a mechanical hydraulic pump which is driven by receiving the rotational drive force of the crankshaft. The oil pump 5, as shown in FIG. 1, draws in an amount of working fluid reserved in an oil pan 5*a* and discharges this working fluid to the downstream side. The discharged working fluid is fed to the fluid pressure chamber 4 via a fluid control mechanism and a fluid switchover mechanism which will be described later. Also, the working fluid discharged from the fluid pressure chamber 4 is returned to the oil pan 5*a* via the fluid control mechanism and the fluid switchover mechanism. Incidentally, an arrangement is provided such that an amount of working fluid leaking from the valve timing control apparatus is collected also at the oil pan 5*a*.

[OCV. OSV]

As shown in FIG. 1 and FIG. 2, the valve timing control apparatus includes the electromagnetic type OCV (oil control valve) 9 acting as the "fluid control mechanism" and the electromagnetic type OSV (oil switching valve) 10 acting as the "fluid switchover mechanism". The OCV 9 and the OSV 10 are connected respectively to the oil pump 5. With the OCV 9, it is possible to control feeding, discharging and maintenance of feeding amount of the working fluid to/from/at the advance angle passage 43, the most retarded angle lock passage 71, and the retard angle passage 44. By controlling the ODSV 10, switching of the feeding/discharging of the working fluid to/from the intermediate lock passage 61 is possible.

The OCV 9 is constructed as a spool type, which is operated under control of electric power supply by the ECU 8 (engine control unit). With this OCV 9, controls are made possible such as working oil feeding to the advance angle chamber 41, working oil discharging from the retard angle chamber 42, working oil discharging from the advance angle chamber 41, working oil feeding to the retard angle chamber 42, and blocking of feeding/discharging of working oil to/from the advance angle chamber 41 and the retard angle chamber 42. The control of working oil feeding to the advance angle chamber 41 and the working oil discharging from the retard angle chamber 42 is the "advance angle control". If this advance angle control is effected, the vane 22 effects relative rotational movement in the advance angle direction S1 relative to the outer rotor 12, so that the relative rotational phase is displaced toward the advance angle side. The control of working oil discharging from the advance angle chamber 41 and the working oil feeding to the retard angle chamber 42 is the "retard angle control". If this retard angle control is effected, the vane 22 effects relative rotational movement in the retard angle direction S2 relative to the outer rotor 12, so that the relative rotational phase is displaced toward the retard angle side. If the control of blocking feeding/discharging of working oil to/from the advance angle chamber 41 and the retard angle chamber 42, the vane 22 does not effect any relative rotational movement, so that the relative rotational phase can be set to any desired phase.

If the advance angle control is effected, working oil is fed to the advance angle passage 43 and the most retarded angle lock passage 71. Under the most retarded angle state, as shown in FIG. 4, the most retarded angle lock passage 71 is closed by the lock member 74. If the lock member 74 is retracted from the most advanced angle lock groove 72 to provide the most retarded angle lock released state with execution of the advance angle control, the most retarded angle lock passage 71 is opened. With this, through the advance angle chamber communication passage 76, the working oil is fed also to the advance angle chamber 41 adjacent the most retarded angle lock mechanism 7, whereby the inner rotor 2 effects a relative rotational movement toward the advance angle side.

Incidentally, in the instant embodiment, it is configured such that in response to power supply (ON) to the OCV 9, the retard angle control is enabled whereas in response to stop (OFF) of power supply to the OCV 9, the advance angle control is enabled. Also, the OCV 9 is configured to set the valve opening ratio through adjustment of the duty ratio of electric power to be supplied to an electromagnetic solenoid. With this, fine adjustment of feeding/discharging mount of working oil is made possible.

The OSV 10 is constructed as a spool type and operates based on switchover of power supply/stop of power supply by the ECU 8. With the OSV 10, it is possible to switch over between feeding of working oil to the intermediate lock groove 62 and the discharging of working oil from the intermediate lock groove 62. Meanwhile, in the instant embodiment, the OSV 10 is configured to enable discharging of working oil from the intermediate lock groove 62 in response to power supply (ON) thereto and configured to enable feeding of working oil to the intermediate lock groove 62 in response to stop of power supply (OFF) thereto.

[Other Arrangements]

Though not shown, there are provided a crank angle sensor for detecting a rotational angle of the crankshaft of the engine and a camshaft angle sensor for detecting a rotational angle of the camshaft 101. The ECU 8 detects a relative rotational phase based on the results of detection by these crank angle sensor and the camshaft angle sensor and determines at which phase the relative rotational phase is currently located. Further, the ECU 8 incorporates signal lines for obtaining ON/OFF information of the ignition key, information from an oil temperature sensor for detecting the oil temperature of the working oil, etc. Also, a memory provided in the ECU 8 stores therein control information of optimum relative rotational phase according to operational conditions of the engine. The ECU 8 controls the relative rotational phase, based on the information of operational conditions (engine rotational speed, cooling water temperature, etc.) and the above-described control information.

As shown in FIG. 1, a torsion spring 3 is provided between the inner rotor 2 and the front plate 11. The torsion spring 3 urges the inner rotor 2 toward the advance angle side so as to resist the averaged displacement force in the retard angle direction based on torque variation of the camshaft. With this, it is possible to displace the relative rotational phase to the advance angle direction in a smooth and speedy manner.

[Operations of Valve Timing Control Apparatus]

Figure 7:
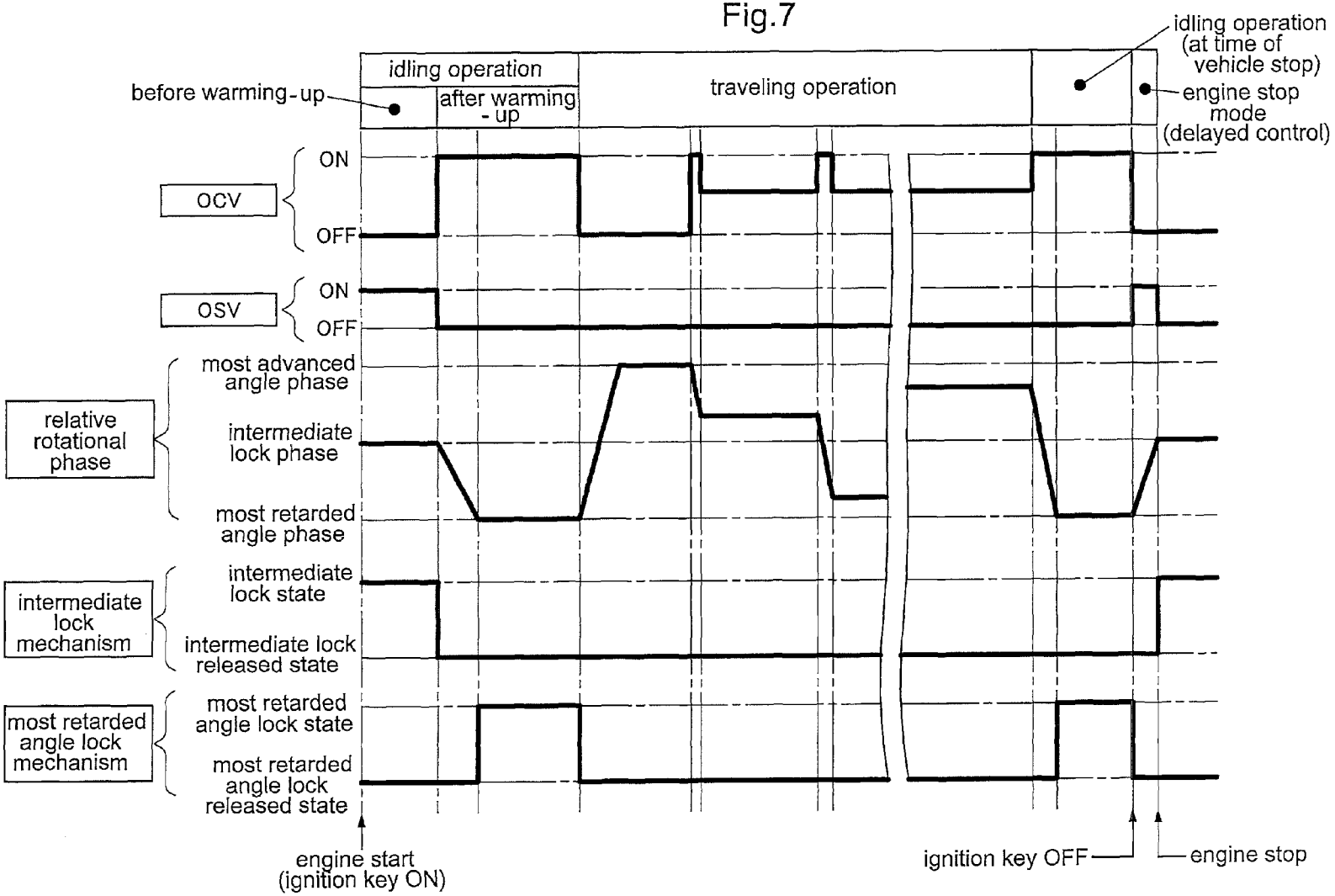
FIG. 7 is a timing chart illustrating operations of the valve timing control apparatus.

Operations of the valve timing control apparatus will be explained with reference to FIGS. 2 through 5. FIG. 7 shows a timing chart of displacement of relative rotational phase from engine startup to engine stop, state of the intermediate lock mechanism 6, the state of the most retarded angle lock mechanism 7, control by the OCV 9 and control by the OSV 10.

Before engine startup, the intermediate locked state is provided by the intermediate lock mechanism 6. And, in response to an ON operation of the unillustrated ignition key, the engine starts under a condition with the relative rotational phase being restrained to the intermediate locked phase (intermediate locked state), as shown in FIG. 2 and then an idling operation (before catalyst warming-up) is initiated. Incidentally, simultaneously with the ON operation of the ignition key, electric power is supplied to the OSV 10 and the intermediate locked state is maintained.

Upon completion of the catalyst warming-up, in order to shift the relative rotational phase to the most retarded angle phase suitable for the idling operation, power is supplied to the OCV 9 for executing the retard angle control and also power supply to the OSV 10 is stopped to feed the working oil to the intermediate lock groove 62. With this, as shown in FIG. 3, the intermediate lock member 64 is retracted from the intermediate lock groove 62, thus realizing the intermediate lock released state. By this retard angle control, the working oil in the most retarded angle lock groove 72 is discharged therefrom. Incidentally, subsequently to the above, as shown in FIG. 7, the stop of power supply to the OSV 10 is continued for maintaining the intermediate lock released state.

As shown in FIG. 4, when the relative rotational phase is displaced to the most retarded angle phase suitable for idling operation and the most retarded angle lock member 74 is caused to face the most retarded angle lock groove 72, the most retarded angle lock member 74 protrudes into the most retarded angle lock groove 72 as shown in FIG. 4, thus realizing the most retarded angle lock state. As a result, no fluttering occurs in the inner rotor 2 and stable idling operation condition can be obtained.

Figure 5:
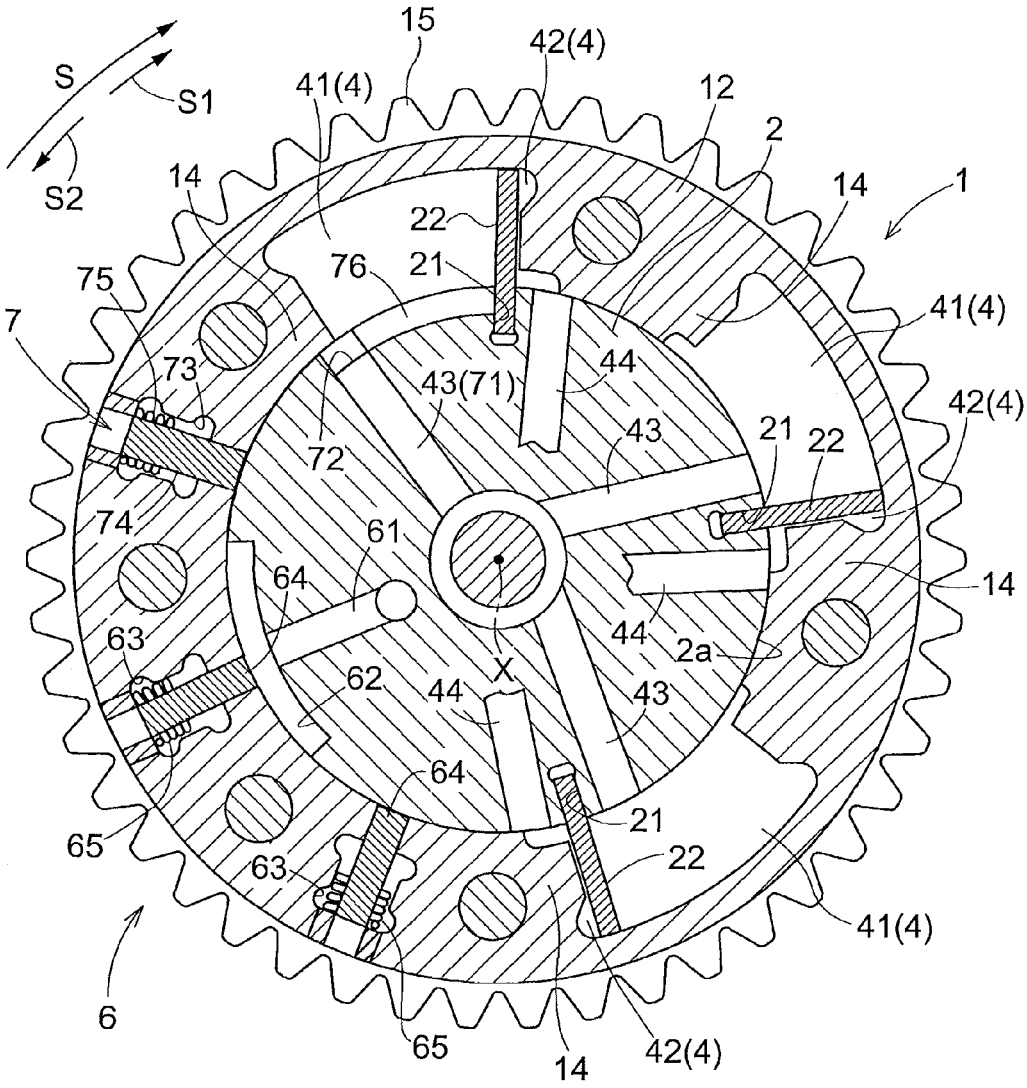
FIG. 5 is a section view showing the valve timing control apparatus when the relative rotational phase is set to a phase on more advance angle side than a lock phase.

Thereafter, when the operational condition becomes the normal traveling operational condition, in accordance with e.g. the load of the engine or the rotational speed, the retard angle control will be executed to displace the relative rotational phase to a phase on more retard angle side than the lock phase or as shown in FIG. 5, the advance angle control will be executed for displacing the relative rotational phase to a phase on more advance angle side than the lock phase or with execution of power supply with duty ratio adjustment, the relative rotational phase will be maintained to a desired phase. With each occurrence of the relative rotational phase becoming the most retarded angle phase, the most retarded angle locked state is provided. However, since this can be immediately rendered into the most retarded angle lock released state with execution of the advance angle control, there occurs no inconvenience.

Normally, a vehicle stopping operation is effected before engine stopping, so there is provided an idling operation. The relative rotational phase becomes the most retarded angle phase and the most retarded angle locked state is provided. In this embodiment, in response to an OFF operation of the ignition key, the ECU 8 renders the engine into the stop mode. Namely, the ECU 8 executes a so-called delay control. More particularly, the ECU 8 does not immediately issue a stopping instruction to the oil pump 5 (engine). Rather, as shown in FIG. 7, the ECU 8 stops the power supply to the OCV 9 and executes the advance angle control. With this, there is provided the most retarded angle lock released state and the relative rotational phase is displaced toward the advance angle side. Also, the ECU 8 initiates power supply to the OSV 10 and discharges the working oil from the intermediate lock groove 62. With this, the relative rotational phase becomes the intermediate locked phase, whereby both of the two intermediate lock members 64 protrude into the intermediate lock groove 62, thus providing the intermediate locked state. Upon lapse of a predetermined period after the OFF operation of the ignition key, the oil pump 5 (engine) is stopped.

Incidentally, with occurrence of an engine stall, the engine may be stopped under the intermediate lock released state. However, when the engine is re-started and it is determined that the relative rotational phase is not the intermediate locked state, the ECU 8 will execute the advance angle control or the retard angle control to render the relative rotational phase to the intermediate lock phase, thus realizing the intermediate locked state reliably. In this way, since the engine can be started under the condition of the relative rotational phase being always restrained to the intermediate lock phase, the engine can operate as a low emission engine. However, since the engine relating to this embodiment can be started even when the relative rotational phase is at the most retarded angle phase as described above, an arrangement of not executing such control at the time of abnormal stop will pose no significant problem.

In the instant embodiment, there was explained the example wherein the OCV 9 enables the retard angle control in response to power supply thereto and enables the advance angle control in response to stop of power supply thereto. The invention is not limited thereto. The OCV 9 may be alternatively configured such that the advance angle control is enabled in response to power supply thereto and the retard angle control is enabled in response to stop of power supply thereto.

Similarly, in the instant embodiment, there was shown the example wherein the OSV 10 is rendered into the condition enabling discharging of working oil from the intermediate lock groove 62 in response to power supply thereto and is rendered into the condition enabling feeding of working oil to the intermediate lock groove 62 in response to stop of power supply thereto. The invention is not limited thereto. The OSV 10 may be alternatively configured such that OSV 10 is rendered into the condition enabling feeding of working oil from the intermediate lock groove 62 in response to power supply thereto and is rendered into the condition enabling discharging of working oil from the intermediate lock groove 62 in response to stop of power supply thereto.

First Alternative Embodiment

In the foregoing embodiment, there was explained the exemplary arrangement wherein the intermediate lock mechanism 6 and most retarded angle lock mechanism 7 respectively include the lock groove 62 and the lock member 64, or the lock groove 72 and the lock member 74. Alternatively, the lock member can be shared by the intermediate lock mechanism 6 and the most retarded angle lock mechanism 7. That is, according to such arrangement, the intermediate lock mechanism 6 and the most retarded angle lock mechanism 7 respectively include a lock groove formed in the inner rotor 2 and share a common lock member which is provided in the outer rotor 12 to be projectable/retractable into/from the respective lock groove, so that when protruded into the lock groove, the lock member is retained in this lock groove to restrain the relative rotational phase of the inner rotor 2 relative to the housing 1 to the intermediate locked phase or the most retarded angle phase. This alternative embodiment will be described next with reference to FIGS. 8 through 10. Explanation of identical arrangement to the foregoing embodiment will be omitted. Further, identical members or components will be denoted with same reference marks/numerals.

Figure 8:
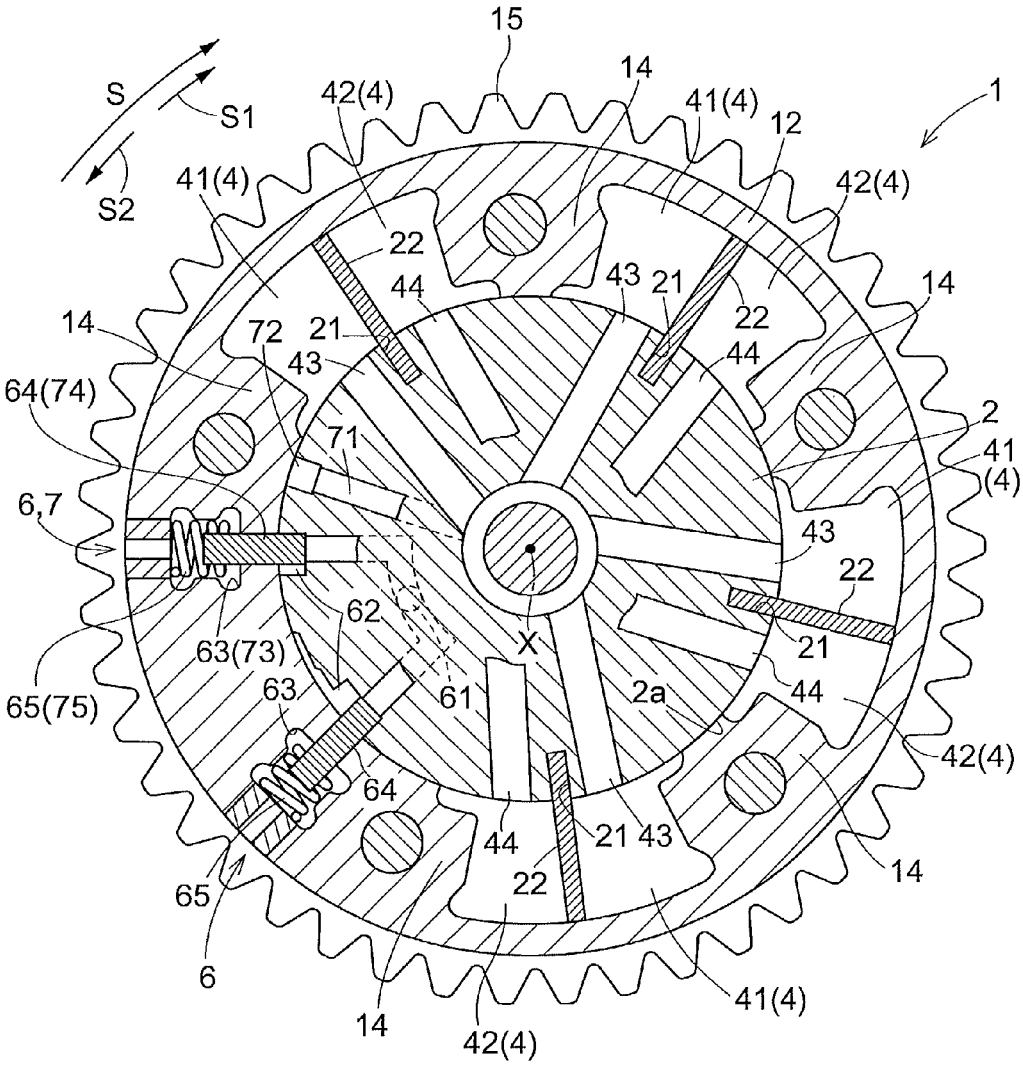
FIG. 8 is a section view of a valve timing control apparatus relating to a first alternative embodiment, showing the valve timing control apparatus under an intermediate locked state.

The intermediate lock mechanism 6, as shown in FIG. 8, includes an intermediate lock passage 61, two intermediate lock grooves 62, an accommodating portion 63, a plate-like intermediate lock member 64, and a spring 65. Of the two intermediate lock grooves 62, the intermediate lock groove 62 (the groove for restricting displacement of the relative rotational phase in the angle advance direction S1) on the retard angle direction S2 side is configured to have a ratchet construction with the depth thereof being increased in the radial direction stepwise along the angle retard direction S2. With this, the lock member 64 is regulated stepwise, so that the intermediate lock member 64 can easily protrude into the intermediate lock groove 62. Incidentally, the intermediate lock passage 61 is branched into two parts in the midst of the inner rotor 2 to be connected to the respective intermediate lock grooves 62.

The most retarded angle lock mechanism 7, as shown in FIG. 8, includes a most retarded angle lock passage 71, a most retarded angle lock groove 72, an accommodating portion 73, a plate-like most retarded angle lock member 74 and a spring 75. The most retarded angle lock passage 71, unlike the foregoing embodiment, is branched from the advance angle passage 43. The most retarded angle lock member 74 is the same as the one intermediate lock member 64 (the member for restricting displacement of the relative rotational phase in the angle retard direction S2) of the two intermediate lock members 64 which one intermediate lock member 64 is disposed on the advance angle direction S1 side. Similarly, the accommodating portion 73 is identical to the one accommodating portion 63 of the two accommodating portions 63 which one accommodating portion 63 is disposed on the advance angle direction S1 side. The spring 75 is identical to the spring 65 disposed within this accommodating portion 63.

Figure 9:
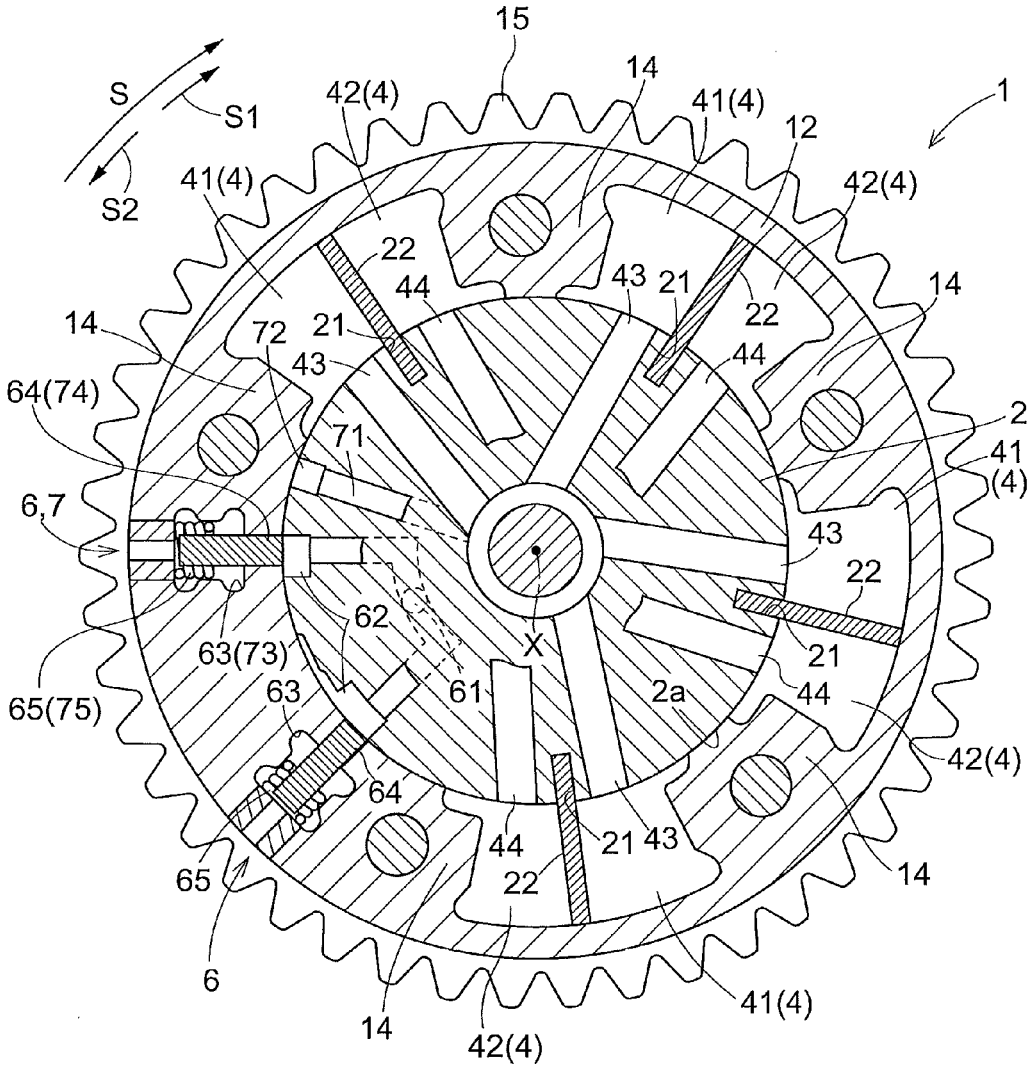
FIG. 9 is a section view showing the valve timing control apparatus when the intermediate locked state shown in FIG. 8 is released.

In these arrangements, like the foregoing embodiment, control operations as shown in FIG. 7 are executed. In the intermediate locked state shown in FIG. 8, if the power supply to the OSV 10 is stopped, there is provided the intermediate lock released state as shown in FIG. 9. Thereafter, as long as the stop of the power supply to the OSV 10 is continued, feeding of the working oil to the intermediate lock groove 62 is continued. Hence, the intermediate lock members 64 will not protrude into the intermediate lock groove 62.

Figure 10:
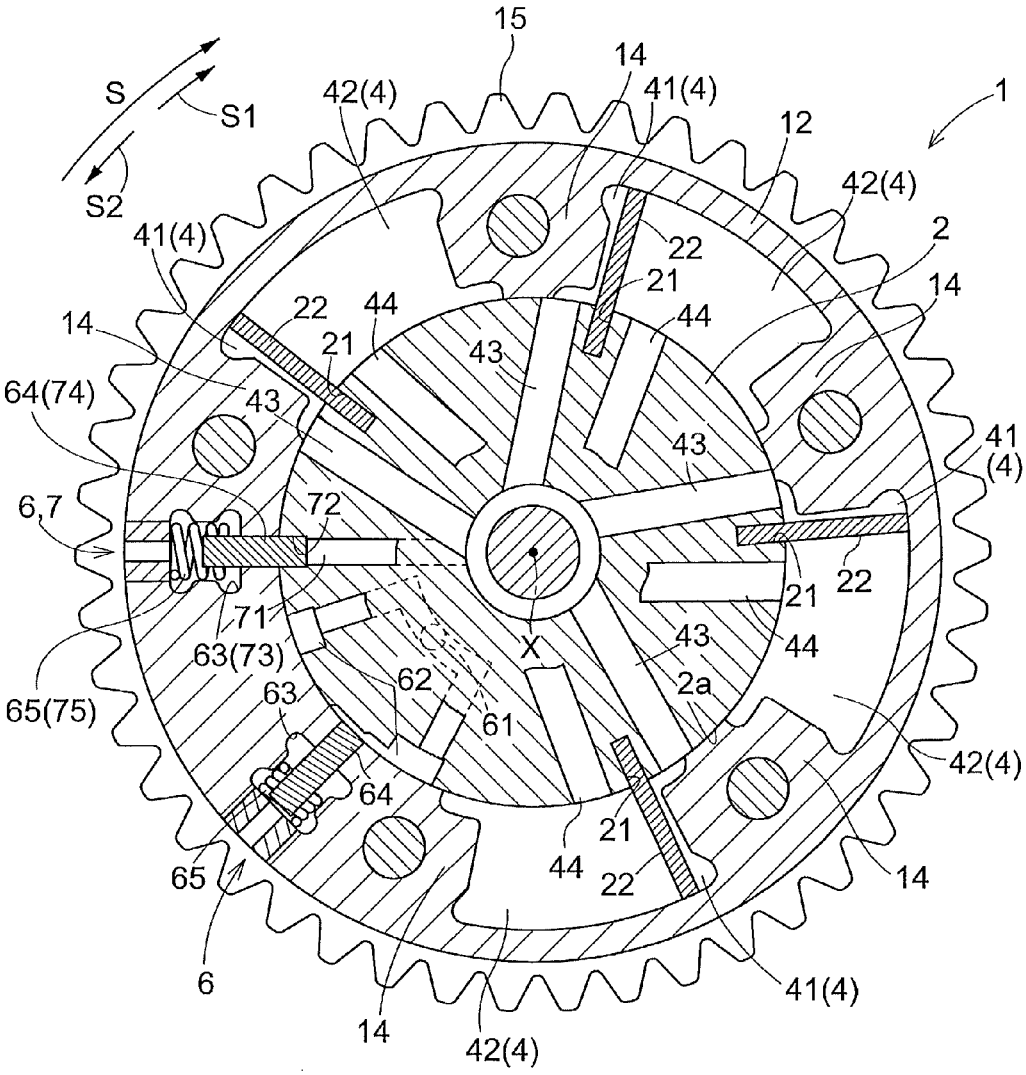
FIG. 10 is a section view of the valve timing control apparatus relating to the first alternative embodiment, showing the valve timing control apparatus when the relative rotational phase is at the most retarded angle phase.

As shown in FIG. 10, when the relative rotational phase is displaced to the most retarded angle phase and the most retarded angle lock member 74 is brought into opposition to the most retarded angle lock groove 72, the most retarded angle lock member 74 (64) protrudes into the most retarded angle lock groove 72 (62), thus providing the most retarded angle locked state.

With the above arrangement of the present embodiment, the construction can be simplified and also the number of parts (components) can be reduced, so that manufacturing cost reduction is made possible. Further, thanks to the co-use of the intermediate lock member 64 and the most retarded angle lock member 74, there is provided spare space in the outer rotor 12 in the peripheral direction. Hence, as shown in FIG. 8, it has been made possible to provide the fluid pressure chambers 4 at four positions. As a result, the force for displacing the relative rotational phase is increased, thus realizing speedy phase displacement. Further, it becomes also possible to increase the peripheral width of the fluid pressure chamber 4, thereby to extend the displaceable range of the relative rotational phase.

Second Alternative Embodiment

Figure 11:
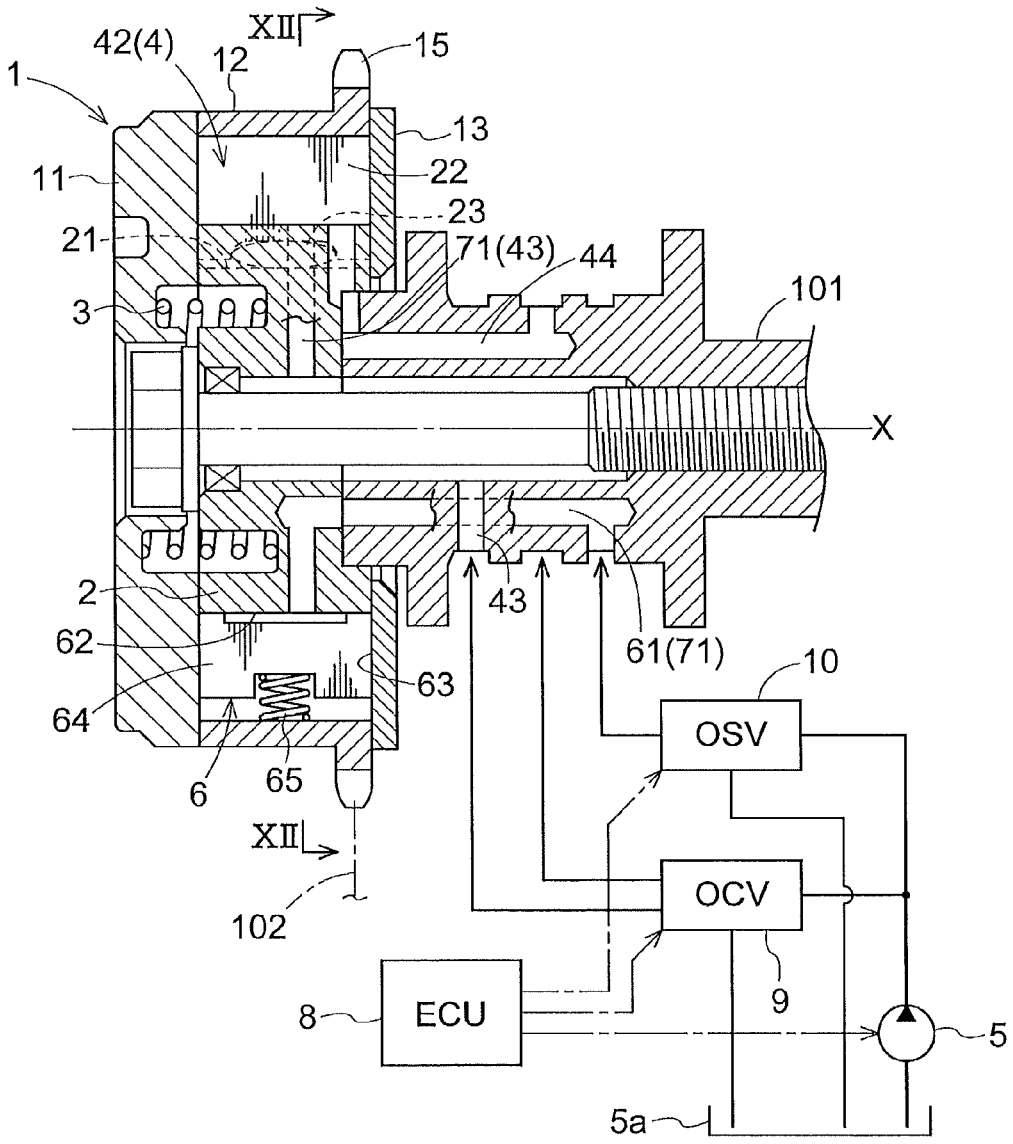
FIG. 11 is a view showing the general construction of a valve timing control apparatus relating to a second alternative embodiment.

In the foregoing embodiment, the intermediate lock mechanism 6 is controlled by the OSV 10 and the most retarded angle lock mechanism 7 is controlled by the OCV 9. The invention is not limited thereto. Alternatively, both the intermediate lock mechanism 6 and the most retarded angle lock mechanism 7 can be controlled by the OSV 10 alone. This alternative embodiment will be described next with reference to FIGS. 11 through 13. Explanation of identical arrangement to the foregoing embodiment will be omitted. Further, identical members or components will be denoted with same reference marks/numerals. As shown in FIG. 11, the layouts of the housing 1, the inner rotor 2, the oil pump 5, the OCV 9, the OSV 10, etc. are identical to those in the foregoing embodiment.

Figure 12:
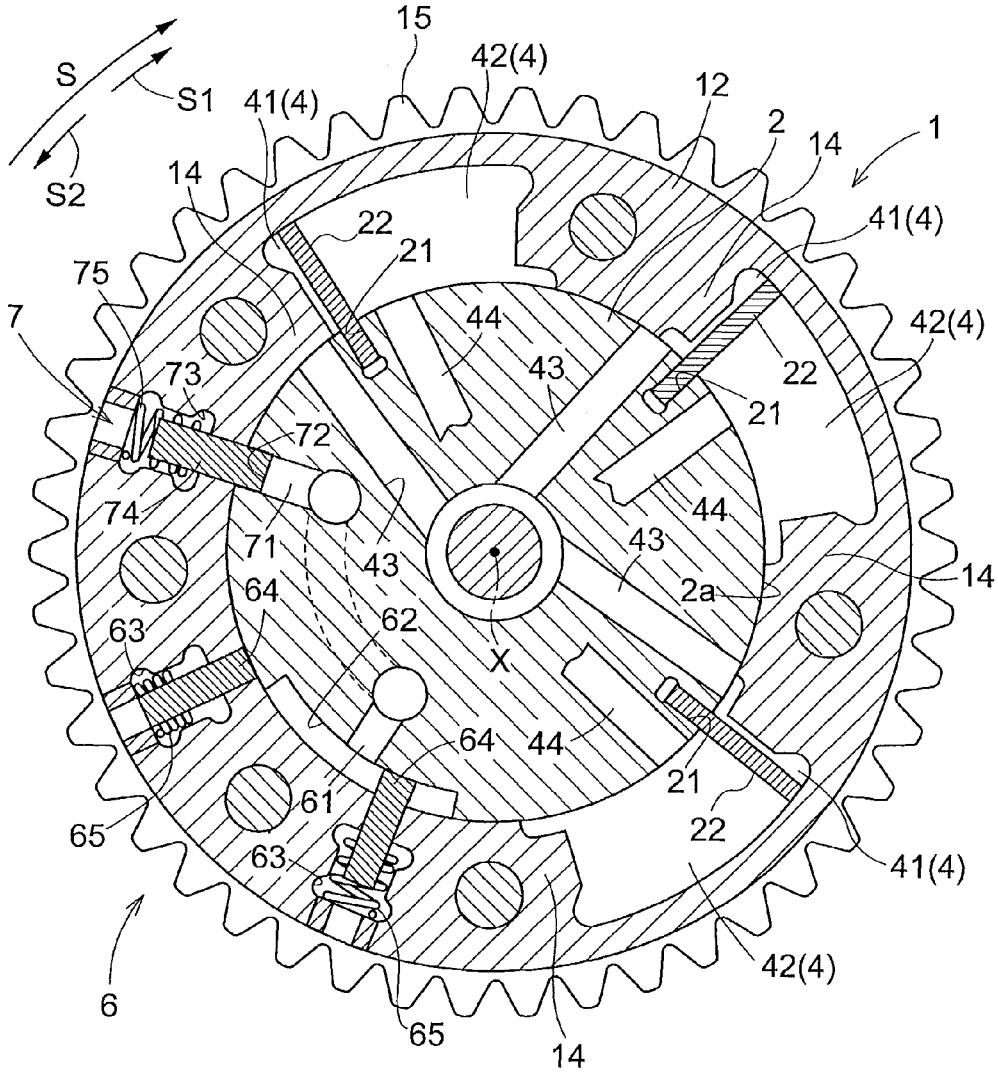
FIG. 12 is a section view taken along XII-XII in FIG. 11, showing the valve timing control apparatus under an intermediate locked state.

As shown in FIG. 12, the intermediate lock passage 61 is branched on the side of the inner rotor 2, with one of them being connected to the intermediate lock groove 62, the other thereof being connected to the most retarded angle lock groove 72. That is, the intermediate lock passage 61 is configured to act also as the most retarded angle lock passage 71. Hence, when the working oil is fed to the intermediate lock passage 61 by controlling the OSV 10, the working oil is fed to both the intermediate lock grove 62 and the most retarded angle lock groove 72. Also, when the OSV 10 is controlled to discharge the working oil from the intermediate lock groove 62, the working oil is discharged also from the most retarded angle lock groove 72.

Figure 13:
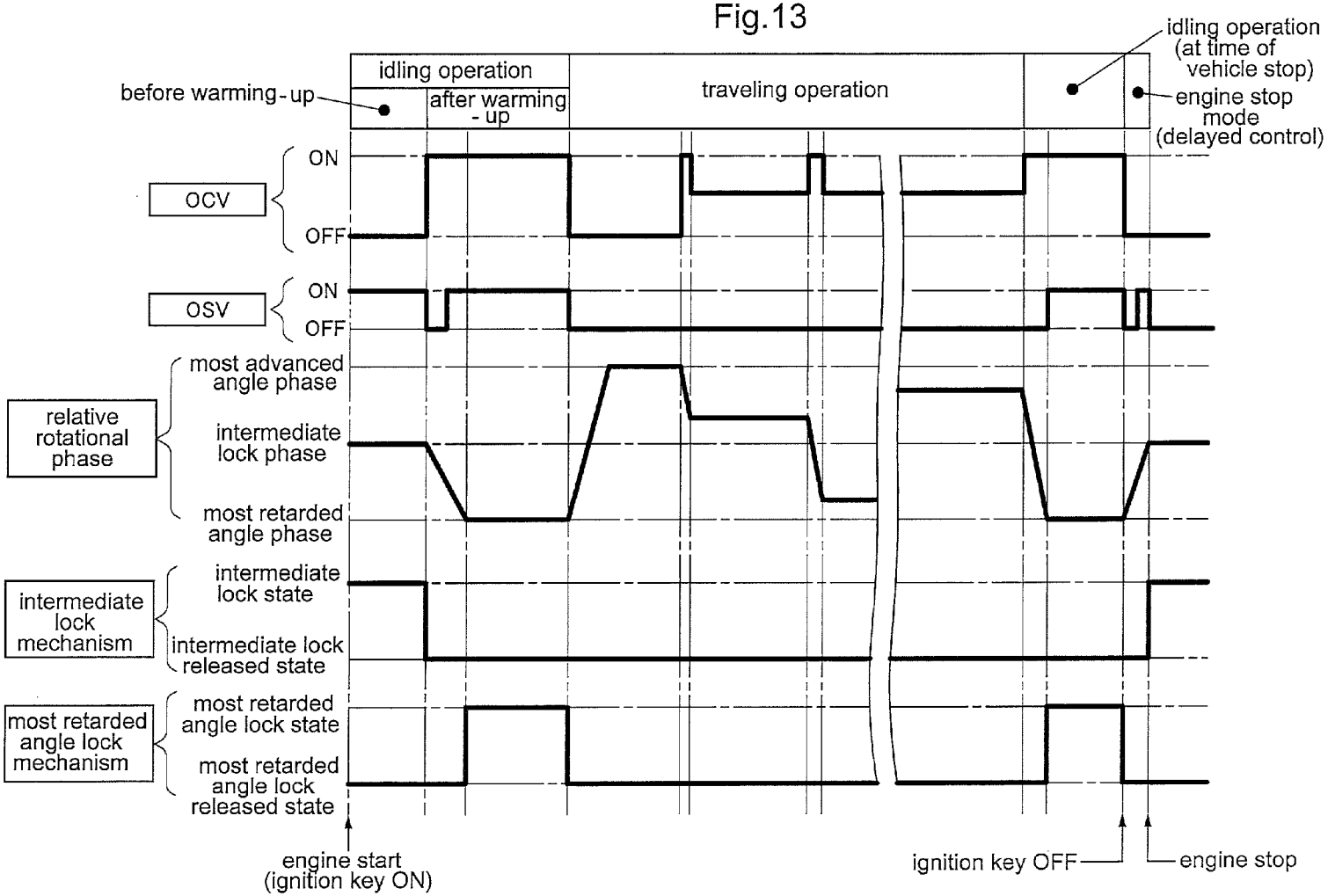
FIG. 13 is a timing chart illustrating operations of the valve timing control apparatus relating to the second alternative embodiment.

Next, operations of the valve timing control apparatus will be explained. FIG. 13 shows a timing chart showing displacement of relative rotational phase from engine startup to engine stop, state of the intermediate lock mechanism 6, state of the most retarded angle lock mechanism 7, control of the OCV 9 and control of the OSV 10. Explanation will be given with reference to the timing chart of FIG. 13. The states of the intermediate lock mechanism 6 and the most retarded angle lock mechanism 7 at each phase are identical to the states of the intermediate lock mechanism 6 and the most retarded angle lock mechanism 7 in the foregoing embodiment, therefore, such section views as FIGS. 2 through 5 will be not shown in particular.

Prior to engine startup, the intermediate locked state is provided by the intermediate lock mechanism 6. Hence, in response to an ON operation of the unillustrated ignition key, the engine will be started under the state of relative rotational phase being restrained to this intermediate lock phase (intermediate locked state) and an idling operation is initiated. Incidentally, simultaneously with the ON operation of the ignition key, power supply to the OSV 10 is effected and the intermediate locked state is maintained.

Upon completion of catalyst warming-up, in order to shift the relative rotational phase to the most retarded angle phase suitable for idling operation, power is supplied to the OSV 9 for executing the retard angle control. Also, the power supply to the OSV 10 is stopped and the working oil is fed to the intermediate lock groove 62 and the most retarded angle lock groove 72. With this, both of the intermediate lock members 64 are retracted from the intermediate lock groove 62, thus realizing the intermediate lock released state. As the relative rotational phase begins to displace toward the retard angle side, power supply to the OSV 10 is initiated, whereby the working oil is discharged from the intermediate lock groove 62 and the most retarded angle lock groove 72 In this, there is the possibility of one of the intermediate lock members 64 protruding again into the intermediate lock groove 62. However, as there is no possibility of both two intermediate lock members 64 protruding into the intermediate lock groove 62, the intermediate lock released state does not change. Moreover, if an arrangement is made such that power supply to the OSV 10 is stopped with execution of the advance angle control, one intermediate lock member 64 which has protruded into the intermediate lock groove 62 will be retracted from this intermediate lock groove 62 immediately.

When the relative rotational phase is displaced to the most retarded angle phase suitable for idling operation and the most retarded angle lock member 74 is brought into opposition to the most retarded angle lock groove 72, as shown in FIG. 12, the most retarded angle lock member 74 will protrude into the most retarded angle lock grove 72, thus providing the most retarded angle locked state. As a result, there occurs no fluttering in the inner rotor 2 and stable idling operational condition can be obtained.

Thereafter, with execution of the advance angle control for shifting to the normal traveling operation, the power supply to the OSV 10 is stopped and the most retarded angle locked state is released. Then, as long as the normal traveling operation is continued, the stopping of the power supply to the OSV 10 is continued, so that intermediate lock released state and the most retarded angle lock released state are maintained.

If a vehicle stopping operation before engine stop is effected, the relative rotational phase becomes the most retarded angle phase, so that the power supply to the OSV 10 is initiated and the most retarded angle locked state is provided. In response to an OFF operation of the ignition key, the ECU 8 renders the engine into the stopped mode. Namely, the ECU 8 executes a so-called delay control. More particularly, the ECU 8 does not issue stop instruction to the oil pump 5 (engine). Rather, as shown in FIG. 13, the ECU 8 issues an instruction for executing the advance angle control by stopping power supply to the OCV 9 and for stopping the power supply to the OSV 10. With this, there is provided the most retarded angle lock released state and the relative rotational phase is displaced toward the advance angle side. When the relative rotational phase begins to displace toward the advance angle side, the ECU 8 initiates power supply to the OSV 10, thus discharging the working oil from the intermediate lock groove 62. with this, as the relative rotational phase becomes the intermediate locked state, both the two intermediate lock members 64 protrude into the intermediate lock groove 62, thus providing the intermediate locked state. Upon lapse of a predetermined period after the OFF operation of the ignition key, the oil pump 5 (engine) is stopped.

According to the instant embodiment, even when the second predetermined phase is not the most retarded angle phase, the relative rotational phase can be restrained to a phase different from the intermediate lock phase. Therefore, the second predetermined phase can be set variably, to suit an effect desired.

In the instant embodiment, there was explained the example wherein the OCV 9 enables the retard angle control in response to power supply thereto and enables the advance angle control in response to stop of power supply thereto. The invention is not limited thereto. The OCV 9 may be alternatively configured such that the advance angle control is enabled in response to power supply thereto and the retard angle control is enabled in response to stop of power supply thereto.

Similarly, in the instant embodiment, there was shown the example wherein the OSV 10 is rendered into the condition enabling discharging of working oil from the intermediate lock groove 62 in response to power supply thereto and is rendered into the condition enabling feeding of working oil to the intermediate lock groove 62 in response to stop of power supply thereto. The invention is not limited thereto. The OSV 10 may be alternatively configured such that OSV 10 is rendered into the condition enabling feeding of working oil from the intermediate lock groove 62 in response to power supply thereto and is rendered into the condition enabling discharging of working oil from the intermediate lock groove 62 in response to stop of power supply thereto.

Other Alternative Embodiments (1) In the foregoing embodiment, there was provided the torsion spring 3 for urging the inner rotor 2 toward the advance angle side. The invention is not limited thereto. For instance, there may be provided a torsion spring for urging the inner rotor 2 toward the retard angle side. With this, the period of the most retarded angle lock member 74 being in opposition to the most retarded angle lock groove 72 will be extended or the opportunities of the opposition thereto will be increased. Whereby, protrusion of the most retarded angle lock member 74 into the most retarded angle lock groove 72 will be facilitated. Further, though not shown, the torsion spring per se may be omitted at all.

(2) In the foregoing embodiment, in both the intermediate lock mechanism 6 and the most retarded angle lock mechanism 7, the lock member was provided in the outer rotor 1 to project/retract radially and the lock groove was provided in the inner rotor 2. The invention is not limited thereto. For instance, though not shown, the lock member may be provided in the front plate 11 or the rear plate 13, to project/retract along the direction of the rotational axis X. Further, in one lock mechanism or in both of the lock mechanisms, the lock member may be provided in the inner rotor 2 and the lock groove may be provided in a member on the side of the housing 1. In these cases, however, it will become necessary to form the lock passage on the housing 1 side or to provide another OSV in addition to the existing OSV 10.

(3) In the foregoing embodiment, the intermediate lock phase is a phase wherein the valve opening timings of the intake valve and the exhaust valve are partially overlapped with each other and wherein HC reduction at the time of engine startup is possible, whereas the most retarded angle phase is a phase adjacent phase where the valve opening timings of the intake valve and the exhaust valve are hardly overlapped with each other and the idling operation is stable. The invention is not limited thereto. For instance, it is possible to configure that the most retarded angle phase is the phase wherein the valve opening timing of the intake valve is delayed relative to the valve closing timing of the exhaust valve, that is, a phase of the so-called "Atkinson range". Further, the intermediate lock phase maybe a phase wherein the idling operation becomes stable and the most retarded angle phase may be a phase wherein the valve opening timing of the intake valve is delayed relative to the valve closing timing of the exhaust valve.

Further, in the case of the hybrid vehicles, if the intermediate lock phase is set to the decompression phase wherein the intake valve can be closed with a delay, at the time of startup of the internal combustion engine, the relative rotational phase can be restrained to the decompression phase by the intermediate lock mechanism 6. As a result, the shock (transfer shock) at the time of switchover from the traveling by the motor to the traveling operation by the internal combustion engine can be alleviated reliably and also the generation of hitting noise at the time of startup of the internal combustion engine can be prevented also.

INDUSTRIAL APPLICABILITY

The present invention may be applied not only to a valve timing control apparatus on the intake side, but also to a valve timing control apparatus on the exhaust side. Further, the invention may be applied to a valve timing control apparatus for an internal combustion engine of an automobile or others.

REFERENCE SIGNS LIST

1 housing (driving-side rotary body)
2 inner rotor (driven-side rotary body)
4 fluid pressure chamber

5 oil pump (working fluid pump)
6 lock mechanism (first lock mechanism)
7 most retarded angle lock mechanism (second lock mechanism)
9 OCV (fluid control mechanism)
10 OSV (fluid switchover mechanism)
22 vane (partitioning portion)
41 advance angle chamber
42 retard angle chamber
43 advance angle passage
62 intermediate lock passage (lock groove)
64 intermediate lock member (lock member)
72 most retarded angle lock groove (lock groove)
74 most retarded angle lock member (lock member)
101 camshaft

The invention claimed is:

1. A valve timing control apparatus comprising:

a driving-side rotary body rotatable in synchronism with a crankshaft of an internal combustion engine;

a driven-side rotary body mounted coaxial relative to the driving-side rotary body and rotatable in synchronism with a valve opening/closing camshaft of the internal combustion engine;

a fluid pressure chamber formed by the driving-side rotary body and the driven-side rotary body and partitioned into a retard angle chamber and an advance angle chamber by a partitioning portion provided in at least one of the driving-side rotary body and the driven-side rotary body;

a fluid control mechanism for controlling feeding of a working fluid from a working fluid pump for feeding the working fluid to the fluid pressure chamber and controlling also discharging of the working fluid from the fluid pressure chamber;

a first lock mechanism configured to restrain a relative rotational phase of the driven-side rotary body relative to the driving-side rotary body to a first predetermined phase between a most retarded angle phase and a most advanced angle phase; and a second lock mechanism configured to restrain the relative rotational phase to a second predetermined phase different from the first predetermined phase, wherein, in the first predetermined phase and in the second predetermined phase, a relative rotational movement of the driven-side rotary body relative to the driving-side rotary body is prevented, regardless of a displacement force in an advance angle direction or a retard angle direction based on torque variations of the camshaft.

2. The valve timing control apparatus according to claim 1, wherein at the time of restraint by the first lock mechanism, the second lock mechanism releases its restraint of the relative rotational phase.

3. The valve timing control apparatus according to claim 1, wherein the first lock mechanism and the second lock mechanism respectively include:

a lock groove formed in either one of the driving-side rotary body and the driven-side rotary body and a lock member provided in the other one of the driving-side rotary body and the driven-side rotary body having the lock groove to be projectable/retractable into/from the lock groove, the lock member being projectable into the lock groove to be retained in this lock groove, thereby to restrain relative rotational movement of the driven-side rotary body relative to the driving-side rotary body.

4. The valve timing control apparatus according to claim 3, wherein an advance angle passage connecting the fluid control mechanism to the advance angle chamber is connected to the lock groove in the second lock mechanism.

5. The valve timing control apparatus according to claim 4, comprising a most retarded angle lock passage connecting the fluid control mechanism and the lock groove of the second lock mechanism, wherein the most retarded angle lock passage acts as the advance angle passage.

6. The valve timing control apparatus according to claim 4, comprising a most retarded angle lock passage connecting the fluid control mechanism and the lock groove of the second lock mechanism, wherein the most retarded angle lock passage is branched from the advance angle passage.

7. The valve timing control apparatus according to claim 1, wherein the first lock mechanism and the second lock mechanism respectively include a lock groove formed in either one of the driving-side rotary body and the driven-side rotary body, and the first lock mechanism and the second lock mechanism share a common lock member provided in the other one of the driving-side rotary body and the driven-side rotary body having the respective lock groove to be projectable/retractable into/from the lock groove, the common lock member being projectable into the respective lock groove to be retained in this lock groove, thereby to restrain relative rotational movement of the driven-side rotary body relative to the driving-side rotary body to either the first predetermined phase or the second predetermined phase.

8. The valve timing control apparatus according to claim 1, further comprising one fluid switchover mechanism for switching over the feeding/discharging of the working fluid to/from the first lock mechanism from/to the second lock mechanism.

9. The valve timing control apparatus according to claim 8, comprising:

an intermediate lock passage connecting the fluid switchover mechanism and a lock groove of the second lock mechanism; and a most retarded angle lock passage connecting the fluid control mechanism and the lock groove of the second lock mechanism, wherein the most retarded angle lock passage is branched from the intermediate lock passage.

10. The valve timing control apparatus according to claim 1, wherein the second predetermined phase is set to a phase on more retarded side than the first predetermined phase.

11. The valve timing control apparatus according to claim 1, wherein the second predetermined phase is set to a phase which is more retard angle side than the first predetermined phase and which is at the most retarded angle phase.

12. The valve timing control apparatus according to claim 1, comprising:

a fluid switchover member configured to switch a supply of the working fluid to the first lock mechanism; and an intermediate lock passage connecting the fluid switchover mechanism and a lock groove of the first lock mechanism.

13. A valve timing control apparatus comprising:

a driving-side rotary body synchronistically rotatable with a crankshaft of an internal combustion engine;

a driven-side rotary body mounted coaxial relative to the driving-side rotary body and synchronistically rotatable with a valve opening/closing camshaft of the internal combustion engine;

a fluid pressure chamber formed by the driving-side rotary body and the driven-side rotary body and partitioned into a retard angle chamber and an advance angle chamber by a partitioning portion fixed to at least one of the driving-side rotary body and the driven-side rotary body;

a fluid control member configured to control: (i) a supply of a working fluid from a working fluid pump to the fluid pressure chamber; and (ii) a discharge of the working fluid from the fluid pressure chamber;

a first lock member configured to prevent the driving-side rotary body and the driven-side rotary body from rotating relative to each other so that the driving-side rotary body and the driven-side rotary body are fixed in a first relative rotational phase; and a second lock member configured to prevent the driving-side rotary body and the driven-side rotary body from rotating relative to each other so that the driving-side rotary body and the driven-side rotary body are fixed in a second relative rotational phase, the second relative rotational phase being different from the first relative rotational phase, wherein, in the first predetermined phase and in the second predetermined phase, a relative rotational movement of the driven-side rotary body relative to the driving-side rotary body is prevented, regardless of a displacement force in an advance angle direction or a retard angle direction based on torque variations of the camshaft.

14. The valve timing control apparatus of claim 13, each of the first lock member and the second lock member comprising: (i) a lock groove formed in either one of the driving-side rotary body and the driven-side rotary body; and (ii) a lock member provided in the other one of the driving-side rotary body and the driven-side rotary body having the lock groove to be projectable/retractable into/from the lock groove, the lock member being projectable into the lock groove to be retained in this lock groove, thereby to restrain relative rotational movement of the driven-side rotary body relative to the driving-side rotary body; and an advance angle passage configured to supply the working fluid from the fluid control member to the advance angle chamber and to the lock groove of the second lock member.

15. The valve timing control apparatus of claim 13, each of the first lock member and the second lock member comprising: (i) a lock groove formed in either one of the driving-side rotary body and the driven-side rotary body; and (ii) a lock member provided in the other one of the driving-side rotary body and the driven-side rotary body having the lock groove to be projectable/retractable into/from the lock groove, the lock member being projectable into the lock groove to be retained in this lock groove, thereby to restrain relative rotational movement of the driven-side rotary body relative to the driving-side rotary body;

an advance angle passage configured to supply the working fluid from the fluid control member to the advance angle chamber; and a most retarded angle lock passage branched from the advance angle passage and configured to supply the working fluid to the lock groove of the second lock member.

16. The valve timing control apparatus of claim 13, further comprising a fluid switchover member configured to switch a supply of the working fluid from the second lock member to the first lock member, and an intermediate lock passage configured to supply the working fluid from the fluid switchover member to a lock groove of the first lock member.

17. The valve timing control apparatus of claim 13, further comprising:

a fluid switchover member configured to switch a supply of the working fluid from/to the first lock member to/from the second lock member;

an intermediate lock passage configured to supply the working fluid from the fluid switchover mechanism to a lock groove of the first lock member; and a most retarded angle lock passage branched from the intermediate lock passage and configured to supply the working fluid to a lock groove of the second lock member.

* * * * *